US009008946B2

(12) United States Patent
Tsuchiya

(10) Patent No.: US 9,008,946 B2
(45) Date of Patent: Apr. 14, 2015

(54) DETECTING DEVICE AND DETECTING METHOD

(71) Applicant: Meiji University, Tokyo (JP)

(72) Inventor: Kazuo Tsuchiya, Kawasaki (JP)

(73) Assignee: Meiji University, Tokyo (JP)

( * ) Notice: Subject to any disclaimer, the term of this patent is extended or adjusted under 35 U.S.C. 154(b) by 0 days.

(21) Appl. No.: 14/286,901

(22) Filed: May 23, 2014

(65) Prior Publication Data

US 2014/0257670 A1 Sep. 11, 2014

Related U.S. Application Data

(63) Continuation of application No. PCT/JP2012/063096, filed on May 22, 2012.

(30) Foreign Application Priority Data

Nov. 28, 2011 (JP) ..... 2011-259502

(51) Int. Cl.

| | |
|---|---|
| ***F02D 29/00*** | (2006.01) |
| ***G01L 23/00*** | (2006.01) |
| ***F02D 41/14*** | (2006.01) |
| *F02D 41/00* | (2006.01) |
| *F02D 41/28* | (2006.01) |

(Continued)

(52) U.S. Cl.

CPC ..... *F02D 29/00* (2013.01); *F02D 41/1401* (2013.01); *F02D 2041/1433* (2013.01); *F02D 2041/288* (2013.01); *F02D 2200/0406* (2013.01); *F02D 2200/101* (2013.01); *F02M 25/0715* (2013.01); *F02D 13/0219* (2013.01)

(58) Field of Classification Search

CPC ..... F02D 29/00; F02D 2200/101; F02D 13/0219; F02D 2200/0406; F02M 25/0715

USPC ..... 701/102, 110, 114, 115, 111; 123/435; 73/114.04

See application file for complete search history.

(56) References Cited

U.S. PATENT DOCUMENTS

| | | | | |
|---|---|---|---|---|
| 4,357,919 | A * | 11/1982 | Hattori et al. | 123/406.16 |
| 4,653,449 | A * | 3/1987 | Kamei et al. | 123/478 |
| 6,810,320 | B2 * | 10/2004 | Yamamoto et al. | 701/111 |

(Continued)

FOREIGN PATENT DOCUMENTS

| | | |
|---|---|---|
| JP | 07180645 | 7/1995 |
| JP | 2000008928 A | 1/2000 |

(Continued)

OTHER PUBLICATIONS

International Search Report for PCT/JP2012/063096 application, mailed Aug. 21, 2012.

*Primary Examiner* — Hieu T Vo

(74) *Attorney, Agent, or Firm* — Wood, Herron & Evans, LLP

(57) ABSTRACT

A detecting device (1) detects a combustion state of an internal combustion engine (2) that transmits power via a crankshaft (11). The detecting device (1) includes a calculation unit (1*b*) that calculates a mass burn fraction by detecting a crank angle, on the basis of a frequency component showing a state change amount of a state change of a detection target according to a change in a cylinder pressure depending on a combustion cycle of the engine (2), and including a harmonic wave component of a fundamental wave of the frequency component.

12 Claims, 28 Drawing Sheets

(51) Int. Cl.
*F02M 25/07* (2006.01)
*F02D 13/02* (2006.01)

(56) References Cited

U.S. PATENT DOCUMENTS 7,133,766 B2 * 11/2006 Kokubo ..... 701/114
7,467,041 B2 * 12/2008 Okubo et al. ..... 701/115

FOREIGN PATENT DOCUMENTS

JP 2004263680 A 9/2004
JP 2005233113 A 9/2005
JP 2009529115 A 8/2009
JP 2010261370 A 11/2010
JP 2011058434 A 3/2011

* cited by examiner

TDC ATDC 10 deg.CA ATDC 20 deg.CA

*MBF* = 0.006 *MBF* = 0.058 *MBF* = 0.141

Gr.1 Cycle No.7 Combustion image (*IMEP* = 397 kPa, $b_1$ = 123 kPa, $b_2$ = 21.3 kPa, $\theta_{MBF}0.5$ = ATDC 52.1 deg.CA)

TDC ATDC 10 deg.CA ATDC 20 deg.CA

*MBF* = 0.010 *MBF* = 0.084 *MBF* = 0.217

Gr.2 Cycle No.12 Combustion image (*IMEP* = 557 kPa, $b_1$ = 167 kPa, $b_2$ = 70.6kPa, $\theta_{MBF}0.5$ = ATDC 36.0 deg.CA)

TDC ATDC 10 deg.CA ATDC 20 deg.CA

*MBF* = 0.026 *MBF* = 0.125 *MBF* = 0.278

Gr.2 Cycle No.8 Combustion image (*IMEP* = 557 kPa, $b_1$ = 166 kPa, $b_2$ = 82.2 kPa, $\theta_{MBF}$0.5 = ATDC 31.4 deg.CA)

TDC ATDC 10 deg.CA ATDC 20 deg.CA

*MBF* = 0.040 *MBF* = 0.203 *MBF* = 0.442

Gr.2 Cycle No.17 Combustion image (*IMEP* = 622 kPa, $b_1$ = 182 kPa, $b_2$ = 115 kPa, $\theta_{MBF}$0.5 = ATDC 22.3 deg.CA)

DETECTING DEVICE AND DETECTING METHOD

CROSS-REFERENCE TO RELATED APPLICATION

This is a Continuation Application of International Application No. PCT/JP2012/063096, filed May 22, 2012, which claims priority to Japanese Patent Application No. 2011-259502 filed on Nov. 28, 2011. The contents of the aforementioned applications are incorporated herein by reference.

BACKGROUND

1. Field of the Invention

The present invention relates to a detecting device and a detecting method that detects the state of an internal combustion engine.

2. Description of Related Art

As measures for realizing low fuel consumption in engines (internal combustion engines) and realizing clean exhaust gas, an engine control unit (ECU) is required to correctly detect an engine combustion state to appropriately perform control according to the detected combustion state. As state variables of the engine combustion state, an indicated mean effective pressure (hereinafter referred to as IMEP), a heat release rate (hereinafter referred to as HR), and a mass burn fraction (hereinafter referred to as MBF), and the like are known. For example, there is a technique showing the engine combustion state depending on IMEP (for an example, refer to Japanese Unexamined Patent Application, First Publication No. 2010-261370). According to this Japanese Unexamined Patent Application, First Publication No. 2010-261370, a technique of analytically calculating IMEP is shown, paying attention to a change in cylinder pressure and cylinder volume being periodic. According to this technique, it is shown that IMEP is calculated by operation processing according to an operational expression including, as variables, the amplitude of a fundamental wave included in a cylinder pressure waveform and the amplitude of a secondary harmonic wave, on the basis of the fundamental wave having the rotational frequency of a crankshaft as a fundamental frequency.

Additionally, in recent years, it is expected that vehicles or hybrid cars be equipped with a function to stop an engine at the time of vehicle stop, which realizes low fuel consumption and clean exhaust gas. In the vehicles equipped with the function to stop an engine at the time of vehicle stop, the stop and start of the engine are frequently and repeatedly performed according to the vehicle stop. Additionally, in the hybrid cars, switching between motor drive and engine drive are performed during traveling. When the motor drive and the engine drive are switched during traveling, repetition of the stop and start of the engine is frequently performed. In the vehicles that realize low fuel consumption and clean exhaust gas by the aforementioned switches, the idling state of the engine is reduced and controlled until a stop state is reached, and thus resulting in engine being restarted.

When the engine of a vehicle starts, the operational state of the engine changes greatly similar to a case where acceleration or deceleration of the vehicle is performed. Therefore, when the engine starts or when there is acceleration or deceleration, it is difficult for an engine control unit to appropriately control engine combustion according to the operational state of the engine.

SUMMARY

Incidentally, to appropriately control combustion of an engine, it may be necessary to change controlled variables to respective actuators that control the engine according to crank angle. In calculating the above controlled variables, the combustion state of the engine is detected from the crank angle, and the state variables showing the combustion state of the engine are calculated by operation processing based on the various detected information. Predetermined controlled variables are calculated in correspondence with the crank angle, on the basis of the calculated state variables.

However, when the operation processing of calculating the state variables showing the combustion state of the engine is performed on the basis of the various kinds of information according to the crank angle, it is necessary to repeatedly perform the operation processing according to detection intervals. For example, it is necessary to perform the operation processing according to respective measurement information items detected with the detection intervals being 1 deg. CA (crank angle), on the basis of the above detection intervals. It is possible to apply a method using such operation processing to an engine as an experimental device. However, when an ECU mounted on an actual vehicle is made to perform such operation processing, the load of the operation processing become heavy. Therefore, it is difficult to apply such operation processing to engines mounted on general vehicles.

Additionally, to directly detect the cylinder pressure showing the combustion state of the engine so as to calculate MBF, it is necessary to provide a special pressure sensor that measures the cylinder pressure in the engine. The aforementioned special pressure sensor requires, for example, high resistance against high temperature and high pressure. Therefore, since the pressure sensor as described above is generally expensive, the sensor is used mainly for experiment. Even if such a cylinder pressure measuring method can be applied to the engine as the experimental device, it is difficult to apply this method to engines mounted on general vehicles. In this way, even if MBF can be used as an index showing the combustion state of the engine as the experimental device as an index for controlling an engine, it is not possible to use MBF as an index showing the combustion state of the engines mounted on the general vehicles.

Meanwhile, according to the technique of Japanese Unexamined Patent Application, First Publication No. 2010-261370, IMEP is calculated on the basis of the measurement information detected by the sensor attached to the outside of an engine combustion chamber. Additionally, IMEP can be calculated without narrowing the detection intervals of the measurement information or the intervals of the operation processing of calculating the controlled variables, unlike the one described above. However, even if there is a disclosure of the technique of calculating IMEP in Japanese Unexamined Patent Application, First Publication No. 2010-261370, there is no disclosure of a technique of calculating MBF. In this regards, it is difficult to calculate MBF as the index showing the combustion state of the engine. Additionally, since MBF cannot be easily calculated from the technique of Japanese Unexamined Patent Application, First Publication No. 2010-261370, it is also difficult to calculate MBF according to the crank angle.

The invention has been made in view of such circumstances, and a purpose thereof is to provide a detecting device and a detecting method that can detect a crank angle without using a special pressure sensor to thereby easily calculate a mass burn fraction.

[1] The invention has been made to solve the above-described problems, and is a detecting device that detects a combustion state of an internal combustion engine that transmits power via a crankshaft. The detecting device includes a calculation unit that calculates a mass burn fraction by detecting a crank angle, on the basis of a frequency component showing a state change amount of a state change of an detection target according to a change in a cylinder pressure depending on a combustion cycle of the engine, and including a harmonic wave component of a fundamental wave of the frequency component.

[2] Additionally, according to the invention, in the above-described invention, the frequency component showing the state change amount of the state change of the detection target is a frequency component including a harmonic wave component of a fundamental wave having a rotational frequency of the crankshaft as a fundamental frequency.

[3] Additionally, according to the invention, in the above-described invention, the calculation unit calculates the mass burn fraction on the basis of a correlation between the harmonic wave component and the crank angle.

[4] Additionally, according to the invention, in the above-described invention, the calculation unit calculates the mass burn fraction, using, as the frequency component, a plurality of frequency components among frequency components corresponding to frequencies of natural number multiples of the fundamental frequency or frequencies of (natural number −0.5) multiples of the fundamental frequency.

[5] Additionally, according to the invention, in the above-described invention, the calculation unit determines any frequency group out of a frequency group including frequencies of natural number multiples of the fundamental frequency according to a rotation speed of the crankshaft per one combustion cycle of the engine or a frequency group including frequencies of (natural number −0.5) multiples of the fundamental frequency, and calculates the mass burn fraction, using, as the frequency component, frequency components corresponding to a plurality of frequencies among frequency included in the determined frequency group.

[6] Additionally, according to the invention, in the above-described invention, the calculation unit includes at least one of the frequency components up to the fifth order of the fundamental wave as the harmonic wave component.

[7] Additionally, according to the invention, in the above-described invention, the calculation unit includes fourth and fifth frequency components of the fundamental wave as the harmonic wave component.

[8] Additionally, according to the invention, in the above-described invention, the calculation unit calculates the mass burn fraction on the basis of an expression showing a combustion model obtained by modeling the combustion cycle of the engine, and including, as variables, a first crank angle according to a timing of ignition in the combustion cycle of the engine, a second crank angle according to a timing of combustion end in the combustion cycle, a third arbitrary crank angle, and a mass burn fraction according to the third crank angle.

[9] Additionally, according to the invention, in the above-described invention, a combustion model coefficient inherent in the combustion model is included in an element of the expression showing the combustion model, and the combustion model coefficient is obtained on the basis of information on a plurality of known sets that are arbitrarily selected among information on sets of crank angles and mass burn fractions according to the crank angles, and the calculation unit calculates the mass burn fraction according to the expression showing the combustion model that is an operational expression including the combustion model coefficient in the element.

[10] Additionally, according to the invention, in the above-described invention, the plurality of known sets that are arbitrarily selected are three sets, a relationship between the respective crank angles of the three sets, and the first crank angle according to the timing of the ignition is represented by Expression (1), and the plurality of known sets are selected so that the relationship between Z of Expression (1) becomes any of 0.5, or 1, 2 and 3.

[Expression 1]

$$\left(\frac{\theta_{MBF2}-\theta_s}{\theta_{MBF3}-\theta_s}\right)^Z=\left(\frac{\theta_{MBF1}-\theta_s}{\theta_{MBF2}-\theta_s}\right) \quad (1)$$

$\theta_{MBF1}$, $\theta_{MBF2}$, and $\theta_{MBF3}$: Crank angles that constitute a set of an arbitrary crank angle and a mass burn fraction according to the crank angle are given in three different sets $\theta_s$: First crank angle according to the timing of ignition

[11] Additionally, according to the invention, the above-described invention, the detecting device further includes a control unit that controls an operational state of the internal combustion engine on the basis of the calculated mass burn fraction.

[12] Additionally, the detecting method of the invention is a detecting method that detects a combustion state of an internal combustion engine that transmits power via a crankshaft. The detecting method includes a process of calculating a mass burn fraction by detecting a crank angle, on the basis of a frequency component showing a state change amount of a state change of a detection target according to a change in a cylinder pressure depending on a combustion cycle of the engine, and including a harmonic wave component of a fundamental wave of the frequency component.

As described above, according to the invention, it is possible to detect the crank angle without using a special pressure sensor to thereby easily calculate the mass burn fraction.

DESCRIPTION OF EMBODIMENTS

Figure 1:
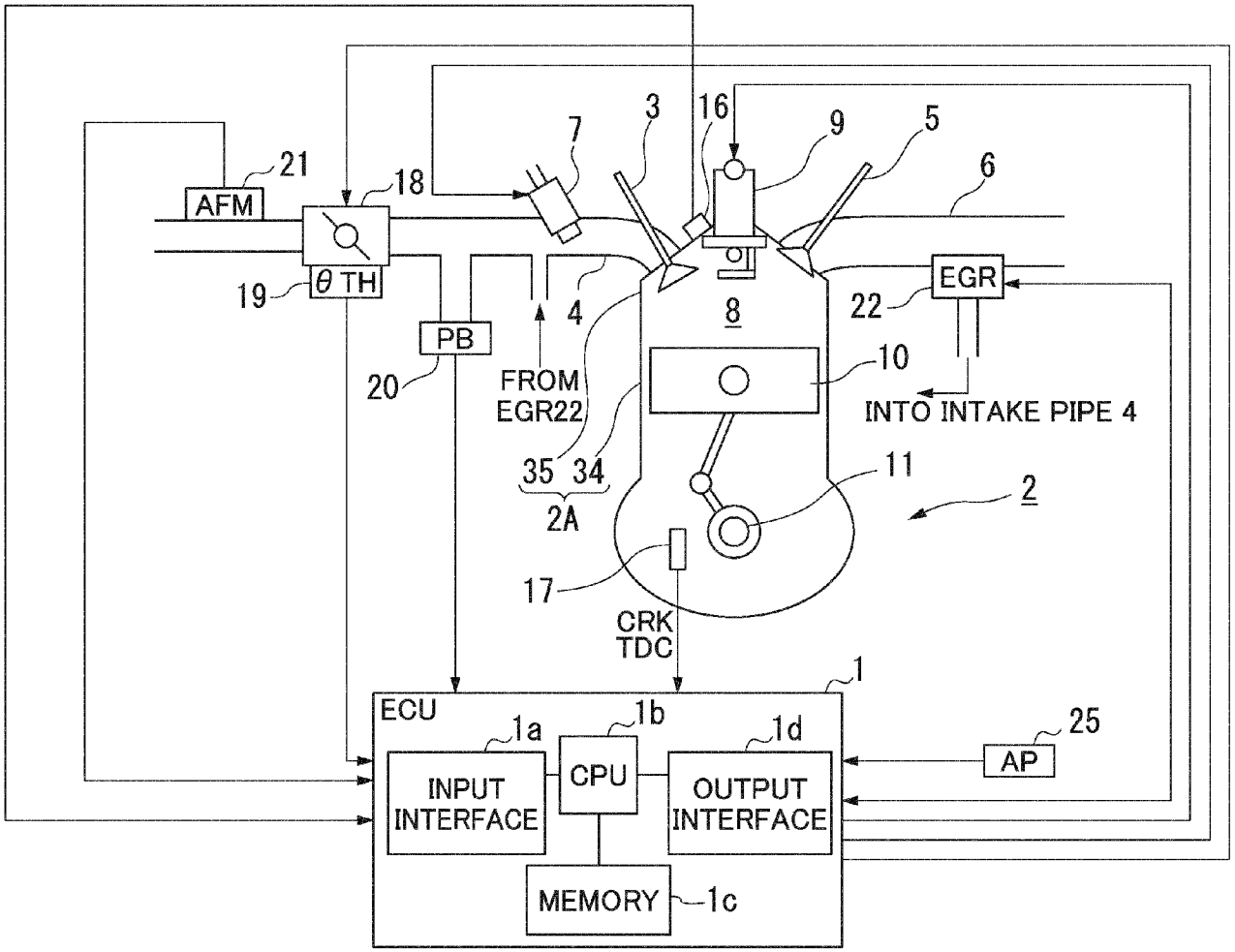
FIG. 1 is a block diagram showing an engine control unit and an engine according to an embodiment of the invention.

Hereinafter, an embodiment of the invention will be described with reference to the drawings. In addition, in the following description, common constituents will be designated with the same reference numerals.

An engine control unit in the present embodiment can detect a crank angle to thereby easily calculate a mass burn fraction. In the following description, a crank angle at which the above mass burn fraction reaches a predetermined value may be referred to as "MBF timing $\theta_{MBF}$".

(Configuration of Engine and Control Unit Thereof in Present Embodiment)

FIG. 1 is an overall block diagram of an engine and a control unit (engine control unit) thereof in the present embodiment.

The engine control unit (hereinafter referred to as "ECU") 1 includes an input interface 1*a* that receives data sent from respective sections of a vehicle (not shown), a CPU 1*b* (control unit) that executes operation for controlling the respective sections of a vehicle, a memory 1*c* having a read-only memory (ROM) and a random access memory (RAM), and an output interface 1*d* that sends control signals to the respective sections of the vehicle. Programs and various data for controlling the respective sections of the vehicle are stored in the ROM of the memory 1*c*. The programs for controlling the engine shown in the present embodiment are stored in the ROM. The ROM may be a rewritable ROM, such as an EPROM. A working area for the operation by the CPU 1*b* is provided in the RAM. The data sent from the respective sections of the vehicle and the control signals to be delivered to the respective sections of the vehicle are temporarily stored in the RAM.

The processing to be performed by the ECU 1 will be described below in detail.

The engine 2 (internal combustion engine) is, for example, a four-cycle engine. The engine 2 is connected to an intake pipe 4 via an intake valve 3, and is connected to an exhaust pipe 6 via an exhaust valve 5. The intake pipe 4 is provided with a fuel injection valve 7 that injects fuel according to a control signal from the ECU 1. The exhaust pipe 6 is provided with an exhaust gas recirculation device (EGR) 22 that shunts a portion of exhaust gas and returns the exhaust gas to an intake system (intake pipe 4), according to a control signal from the ECU 1. The EGR 22 includes various sensors (not shown) for EGR control. Intake pipe pressure PB detected by the various sensors is sent to the ECU 1.

The engine 2 sucks an air-fuel mixture of the air sucked from the intake pipe 4 and the fuel injected from the fuel injection valve 7 to a combustion chamber 8. The combustion chamber 8 is provided with an ignition plug 9 that causes sparks according to an ignition timing signal from the ECU 1. The air-fuel mixture is combusted by the sparks emitted from the ignition plug 9. The volume of the air-fuel mixture is increased by the combustion, and this pushes the piston 10 downward. The reciprocating motion of the piston 10 is converted into the rotational motion of a crankshaft 11.

The engine 2 is provided with a crank angle sensor 17. The crank angle sensor 17 sends a CRK signal and a TDC signal, which are pulse signals, to the ECU 1 with the rotation of the crankshaft 11. The CRK signal is a pulse signal to that is outputs at a predetermined crank angle (15 degrees in this embodiment). The ECU 1 calculates an rotation speed NE of the crankshaft 11 in the engine 2 according to the CRK signal. The TDC signal is a pulse signal output at a crank angle related to the TDC position of the piston 10.

The intake pipe 4 of the engine 2 is provided with a throttle valve 18. The opening degree of the throttle valve 18 is controlled by the control signal from the ECU 1. A throttle valve opening degree sensor (θTH) 19 connected to the throttle valve 18 sends an electrical signal according to the opening degree of the throttle valve 18 to the ECU 1.

An intake pipe pressure (PB) sensor 20 is provided on the downstream side of the throttle valve 18. The intake pipe pressure PB detected by the PB sensor 20 is sent to the ECU 1.

An air flow meter (AFM) 21 is provided upstream of the throttle valve 18. The air flow meter 21 detects the volume of air that passes through the throttle valve 18, and sends the air volume to the ECU 1.

An accelerator pedal opening degree sensor (AP) 25 is connected to the ECU 1. The accelerator pedal opening degree sensor 25 detects the opening degree of an accelerator pedal, and sends the opening degree to the ECU 1.

In the engine 2 in the present embodiment, a cylinder structure 2A (FIG. 2) is formed by a cylinder block 34, and a cylinder head 35 formed so as to cover an upper portion (upper side in the drawing) of a cylinder.

A cylinder head 35 is provided with a sensor unit 16. The sensor unit 16 indirectly detects a change in the cylinder pressure of a predetermined cylinder of the engine 2, and sends the change to the ECU 1. For example, the sensor unit 16 is a gap sensor that detects the deformation volume of the cylinder head 35.

Additionally, although not shown, the engine 2 can include a mechanism that variably drives the phase and lift of the intake valve and/or the exhaust valve, a mechanism that makes the compression ratio of the combustion chamber variable, a mechanism that adjusts intake pressure, or the like.

The signals sent toward the ECU 1 are processed by the input interface 1*a*. The input interface 1*a* performs analog-to-digital conversion of the sent signals. The CPU 1*b* processes the converted digital signals according to the programs stored in the memory 1*c*, and creates control signals to be sent to actuators of the vehicle. The output interface 1*d* sends the control signals to the actuators of the fuel injection valve 7, the ignition plug 9, the throttle valve 18, the EGR 22, and the other machine elements.

The detection of the behavior of the cylinder structure 2A will be described with reference to FIGS. 2 and 3, taking a case where the invention is applied to a single cylinder type engine (single cylinder engine) as an example.

Figure 2:
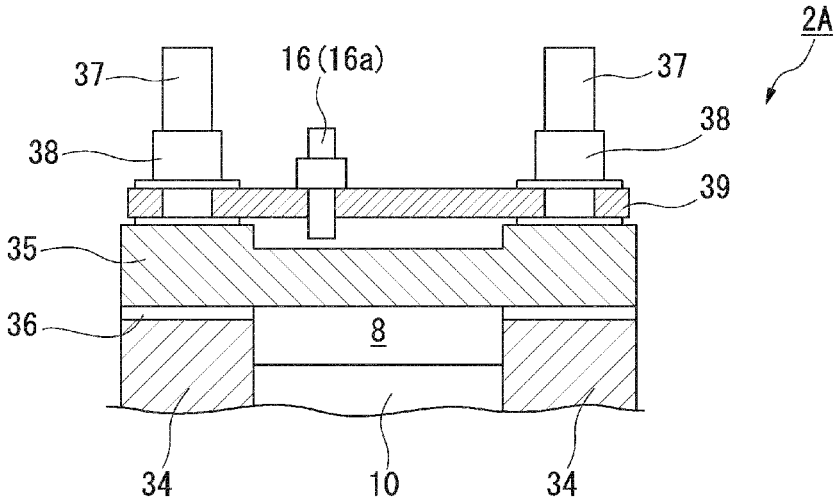
FIG. 2 is a schematic view (1) showing the positions of sensors in a cylinder structure in the present embodiment.
Figure 3:
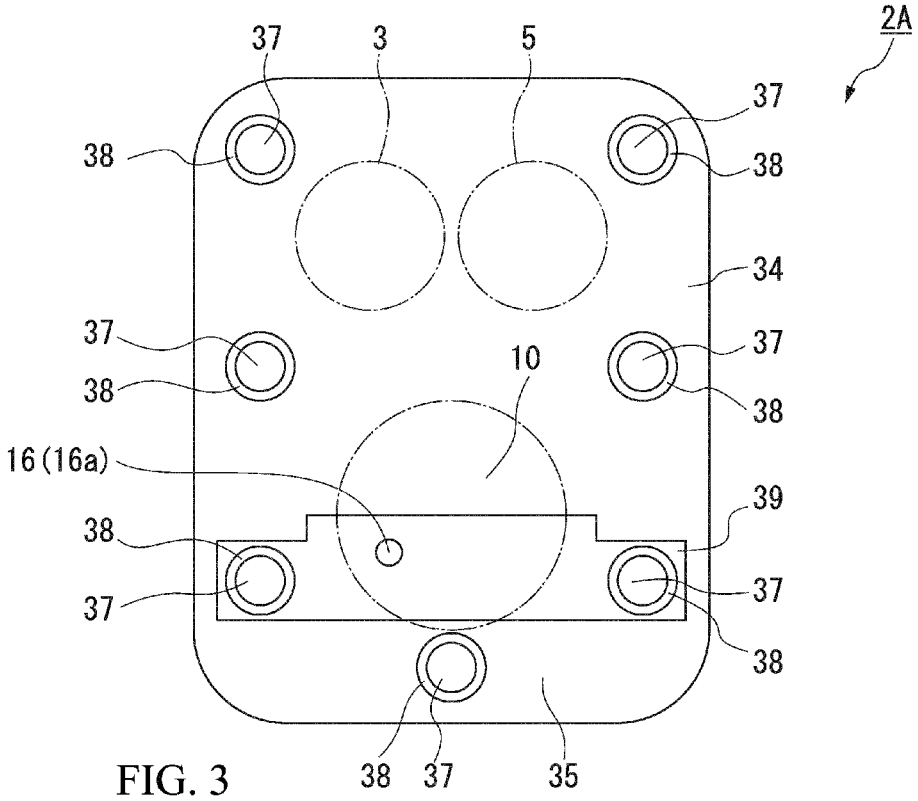
FIG. 3 is a schematic view (2) showing the positions of the sensors in the cylinder structure in the present embodiment.

FIGS. 2 and 3 are schematic views showing the positions of sensors in the cylinder structure. FIG. 2 shows a cross-section of the cylinder structure 2A, and FIG. 3 shows a plan view of the cylinder structure 2A viewed from a cylinder head 35 side. The arrangement of the sensor unit 16 shown in FIG. 2 is shown as an example.

As shown in FIG. 2, the cylinder structure 2A is provided with the sensor unit 16 that detects the behavior of the cylinder structure 2A. The cylinder structure 2A is obtained by combining the cylinder block 34 and the cylinder head 35, and the cylinder block 34 and the cylinder head 35 are fastened to each other with bolts 37 and nuts 38 with a gasket 36 interposed therebetween.

Additionally, an upper portion of the cylinder head 35 is provided with an anchor block 39, and the anchor block 39 is fastened to the cylinder head 35 with the aforementioned bolts 37 and nuts 38. The anchor block 39 is provided with the sensor unit 16, and the sensor unit 16 is held by the anchor block 39 in a state where a gap of predetermined spacing is maintained between the sensor unit 16 and the cylinder head 35.

As shown in FIG. 3, the position of the sensor unit 16 is provided so as to become the position of the combustion chamber in a state where the cylinder head 35 is viewed in a plan view.

Here, the sensor unit 16 is a sensor that detects the behavior of the cylinder structure 2A. For example, the sensor unit 16 detects the behavior of the cylinder structure 2A, that is, a force acting on the cylinder structure 2A, gaps, acceleration, the deformation of the cylinder structure 2A, or the like. The cylinder pressure changes in four strokes of intake, compression, explosion, and exhaust of one cycle of the engine 2. A stress or gap change, the acceleration, and the deformation in the cylinder structure 2A are caused according to a change in the cylinder pressure, a correlation is present among the change in the stress or gap and changes in respective physical quantities showing the acceleration and the deformation, in the cylinder structure 2A, and the change in the cylinder pressure.

According to an example shown in FIG. 2, minute displacement is caused on the surface of the cylinder head 35 due to the change in the cylinder pressure by a combustion cycle. By adopting such a configuration, the sensor unit 16 detects the minute displacement of the surface of the cylinder head 35 as a change in the spacing between the sensor unit 16 and the cylinder head 35.

In the ECU 1, the input interface 1*a* performs input processing of a detection signal detected by the sensor unit 16, and obtains a signal related to a stroke cycle. Additionally, the CPU 1*b* performs operation processing of the signal related to the above stroke cycle, and calculates a cylinder pressure instantaneous value, an indicated mean effective pressure, and the crank angle at which the mass burn fraction, as the state variables showing the combustion state of the engine 2.

In addition, the sensor unit 16 is not limited to that shown in FIGS. 1 to 3. Additionally, the attachment position of the sensor unit 16 is not limited to that shown in FIGS. 1 to 3.

For example, as types of behavior that occurs in the cylinder structure 2A that is a detection target, for example, there are a change in the stress in the cylinder structure 2A, a change in the gap between the cylinder block 34 and the cylinder head 35, a change in the gap of the gasket 36 between the cylinder block 34 and the cylinder head 35, a change in the acceleration acting on the cylinder structure 2A, and deformation in the cylinder structure 2A.

As a more specific example, a sensor unit 16 (a pressure sensor) that detects the stress of a detection target, may be made to correspond to each detection target and be provided at any of the bolts 37 that fastens the cylinder block 34, the gasket 36, and the cylinder block 34 and the cylinder head 35. The sensor unit 16, which is a sensor including, for example, a piezoelectric device, generates a cylinder pressure signal according to the cylinder pressure in the combustion chamber 8, and sends the signal to the ECU 1.

Additionally, a sensor unit 16 (a gap sensor) that detects the gap between the cylinder block 34 and the cylinder head 35 may be provided at the gap between the cylinder block 34 and the cylinder head 35. A gap sensor for detecting the gap of the gasket 36 may be provided at the gap of the gasket 36.

Additionally, a sensor unit 16 (an acceleration sensor) that detects vibration in the cylinder block 34 as the acceleration may be provided at the cylinder block 34, and an acceleration sensor that detects the acceleration acting on the cylinder head 35 may be provided at the cylinder head 35.

Additionally, a sensor unit 16 (a gap sensor, a strain detection sensor) that detects the deformation of the cylinder structure 2A may be provided at the cylinder structure 2A.

The aforementioned respective sensors may be used independently, may be used in combination with other sensors, or may be selectively used if necessary.

In addition, although the engine shown in this drawing is a single cylinder type engine, a multi-cylinder type engine is also applicable to the present embodiment. Additionally, although this engine is a side valve type engine, the detecting method of the present embodiment is not limited by the arrangement of the engine valve.

(Calculation Formula of Indicated Mean Effective Pressure, Heat Release Rate, and Mass Burn Fraction)

Here, the calculation of the indicated mean effective pressure (IMEP), the heat release rate (HR), and the mass burn fraction (MBF), which are known as the state variables showing the combustion state of the engine, is shown.

First, a technique of analytically obtaining IMEP, paying attention to changes in the cylinder pressure and cylinder volume being periodic, will be simply described. When a fundamental frequency is used as the rotational frequency of the crankshaft, IMEP can be calculated according to Expression (2) and Expression (3) by defining the amplitude of a fundamental wave included in a cylinder pressure waveform as $b_1$ and defining the amplitude of a secondary harmonic wave as $b_2$ (for details, refer to Japanese Unexamined Patent Application, First Publication No. 2010-261370). Specifically, in the case of an engine in which the crankshaft 11 is operated at 6000 rpm as the rotation speed NE thereof, an amplitude in which $b_1$ is a 100 Hz component and $b_2$ is a 200 Hz component is obtained. The frequency of $b_1$ and $b_2$ changes depending on the rotation speed NE of the crankshaft 11. IMEP can be calculated by operation processing based on the output of a sensor that is attached to the outside of the combustion chamber of the engine and detects stress, strain, displacement, acceleration, or the like.

[Expression 2]

$$IMEP = \frac{\pi}{2h}\left(b_1 + \frac{1}{2\lambda}\left(1 + \frac{1}{4\lambda^2}\right)b_2\right) \tag{2}$$

[Expression 3]

$$b_k = \frac{2}{n}\sum_{j=1}^{n} P_j \sin\frac{2\pi kj}{nh} \tag{3}$$

$b_k$: Amplitude of k-th harmonic wave included in cylinder pressure P (Fundamental wave when k=1)

h: Cycle coefficient (4 cycle h=½, 2 cycle h=1)

n: Number of data items of cylinder pressure of one cycle j: Data number

λ: Connecting rod stroke ratio (length of connecting rod/radius of crank)

Additionally, HR is calculated as a value per unit stroke volume ($V_s$: stroke volume) according to the following Expression (4) from a cylinder pressure P and a combustion volume V detected at every 1 deg. CA on the basis of the crank angle.

[Expression 4]

$$HR_i = \frac{1}{\kappa - 1}\left(V_i \frac{P_{i+1} + P_{i-1}}{2} + \kappa P_i \frac{V_{i+1} + V_{i-1}}{2}\right)\frac{1}{V_s} \tag{4}$$

In the above Expression (4), shifting is made as a whole and an atmospheric pressure position is corrected so that polytropic compression is obtained between BTDC 100 deg. CA to 65 deg. CA. In the case of the present embodiment, a polytropic index is κ=1.32.

MBF is calculated by substituting HR calculated by Expression (4) into Expression (5).

[Expression 5]

$$MBF_i = \sum_{j=s}^{i} HR_i \Big/ \sum_{j=s}^{e} HR_i \tag{5}$$

k: Polytropic index i, j: Data number s, e: Combustion start, combustion end (Duration in which HR remains as a positive value continuously)

As resolving power in the aforementioned calculation method of HR and MBF, it is required that values are obtained at every 1 deg. CA. Therefore, to detect the combustion state of the engine that changes every moment according to the above-described calculation method, calculation is continuously required at every 1 deg. CA. Additionally the maximum heat release rate $HR_{max}$, the crank angle $\theta_{HRmax}$, and the MBF timing $\theta_{MBF}$ are required to perform operation processing by secondary interpolation. The same applies for the maximum cylinder pressure $P_{max}$ and the crank angle $\theta_{Pmax}$.

However, the above Expression (4) and Expression (5) are used for the description of the following principle.

Additionally, in the calculation of MBF, it is also possible to use $a_k$ represented by the total of the product of the cylinder pressure and a cosine function as in the following Expression (3)' as the amplitude of a k-th harmonic wave instead of using $b_k$ represented by the total of the product of the cylinder pressure and a sine function being used as the amplitude of the k-th harmonic wave as the above Expression (3).

[Expression 6]

$$a_k = \frac{2}{n}\sum_{j=1}^{n} P_j \cos\frac{2\pi kj}{nh} \quad (3)'$$

[Study of Combustion Characteristics from Start to Steady Operation]

(Principle of Detecting MBF Timing $\theta_{MBF}$)

Changes in the combustion state from start to the steady operation will be described with reference to FIGS. 4 to 7.

First, a verification experiment performed for describing the principle in the present embodiment will be described.

To capture combustion images for this verification experiment, a glass engine is used in which a portion of the piston 10 is formed of a glass material serving as an observation window. In various types of measurement shown below, measured is the duration until IMEP settles at an approximately constant value while increasing after ignition start and firing from motoring in a state where the opening degree of the throttle valve 18 is full-open and the rotation speed NE (crank rotation speed) of the crankshaft 11 is fixed to 1000 rpm. Specifically, the duration in which the measurement is performed is duration up to first fifty cycles including the motoring, and this duration is used as the start duration of the engine.

The cylinder pressure is measured at intervals of 1 deg. CA in synchronization with a crankshaft rotation angle by a pressure sensor (not shown) and a charge amplifier (not shown) that are provided at the combustion chamber 8 for the experiment. The fuel is supplied from the fuel injection valve attached to the intake pipe, and the injection duration thereof is adjusted to set A/F (air-fuel ratio). A/F used as a reference is 15, and ignition timing is BTDC 20 deg. CA.

Additionally, the capturing of the combustion images (FIGS. 6A to 6D) is performed in sixteen continuous cycles from the ignition start at a speed of 6500 fps (frame per second) at every 1 deg. CA in synchronization with the measurement of the cylinder pressure, in a bottom view from a glass piston side using a high-speed camera.

Figure 4:
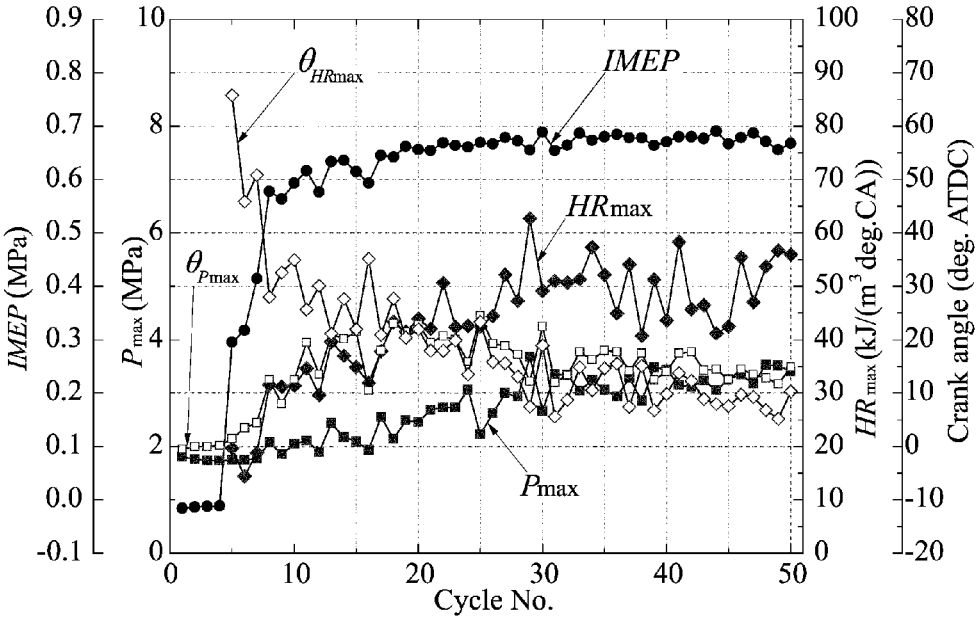
FIG. 4 is a view showing the states of combustion parameters from start to a steady operation.

FIG. 4 is a view showing the states of combustion parameters from start to the steady operation.

Changes in the combustion parameters (vertical axis) due to respective cycles (horizontal axis) from the start to the steady operation are shown in FIG. 4. Cycle number (No) shown on the horizontal axis represents the number of cycles in the case of a four-cycle engine that has two rotations of the crankshaft 11 as one cycle. Additionally, as the combustion parameters shown on the vertical axis, the maximum cylinder pressure $P_{max}$; the crank angle $\theta_{Pmax}$, IMEP, the maximum heat release rate $HR_{max}$ corresponding to the maximum cylinder pressure $P_{max}$; and the crank angle $\theta_{HRmax}$ corresponding to the maximum heat release rate $HR_{max}$ are shown.

The state up to Cycle No. 4 in which IMEP takes negative values is a motoring state. A firing state is brought about in Cycle No. 5, and thereafter, shift is made to the steady operation in which IMEP settles at an approximately constant value while increasing. Both of $P_{max}$ and $HR_{max}$ increase as the cycles proceed. On the other hand, $\theta_{Pmax}$ is retarded up to a value immediately before reaching a predetermined value in the steady operation, and settles in a range of the predetermined value in the operation in a place slightly returned from a maximum retard angle to a top dead center (TDC) side if entry into the steady operation is allowed. $\theta_{HRmax}$ reaches the predetermined value in the steady operation when advance is performed monotonously from the start.

Here, the combustion state at the start time is classified into groups, on the basis of changes (combustion patterns (HR and MBF patterns)) in the combustion parameters at the start time. Here, the combustion state is classified into four groups, and the classified groups are designated as Group 0 to Group 3, respectively, and are represented like Gr.0 to Gr.3, respectively.

FIGS. 5A to 5D are views showing the states of the combustion parameters classified into respective groups of Gr.0, Gr.1, Gr.2, and Gr.3 according to the combustion state.

Changes in the combustion parameters (vertical axis) from the crank angle (horizontal axis) are shown in FIGS. 5A to 5D. As the combustion parameters shown on the vertical axis, the cylinder pressure P, HR, and MBF are shown.

Figure 5A:
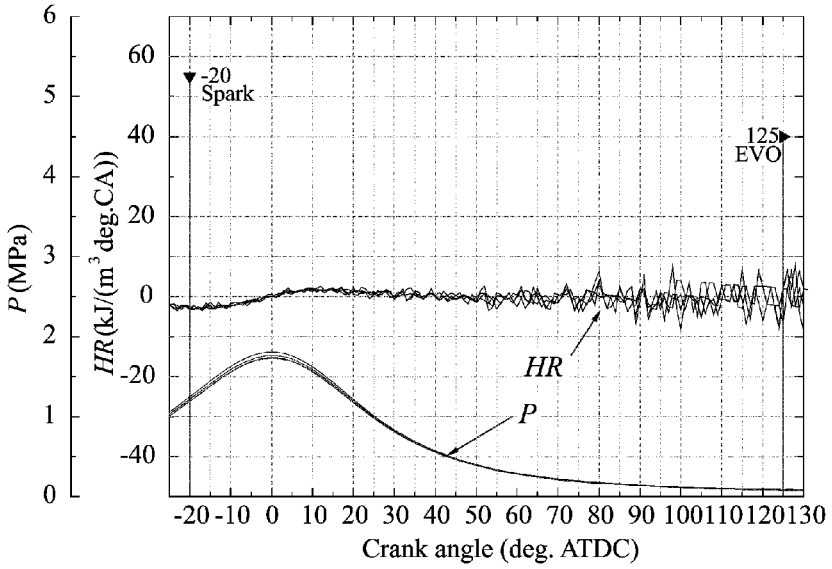
FIG. 5A is a view showing the states of the combustion parameters from the start to the steady operation, which are classified into groups according to a combustion state.

Group 0 (Gr.0) shown by FIG. 5A is grouped at the time of the motoring.

Figure 5B:
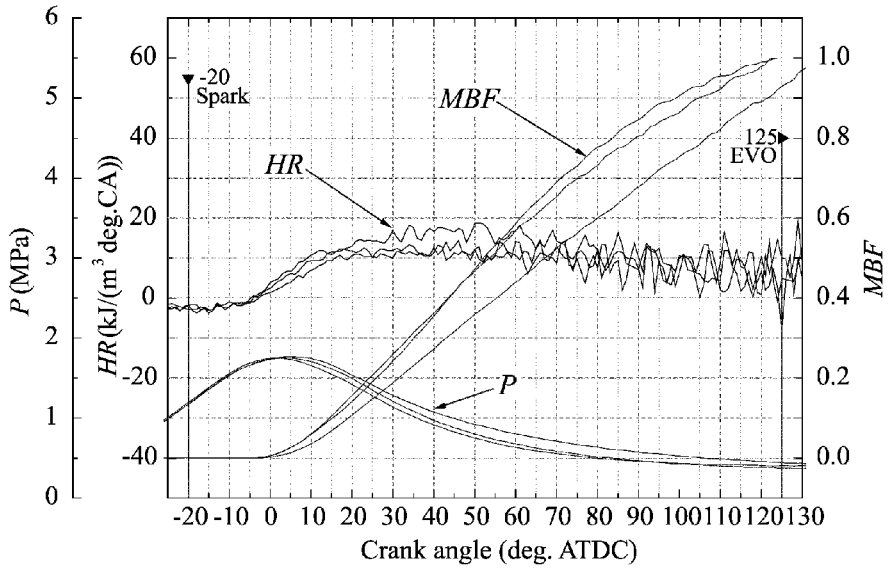
FIG. 5B is a view showing the states of the combustion parameters from the start to the steady operation, which are classified into the groups according to the combustion state.

Group 1 (Gr.1) shown by FIG. 5B is obtained by grouping first three cycles after the start of the firing. According to a combustion pattern shown in FIG. 5B, a maximum value ($P_{max}$) of P is approximately equal to motoring pressure, and a maximum value ($HR_{max}$) of HR is small.

Figure 5C:
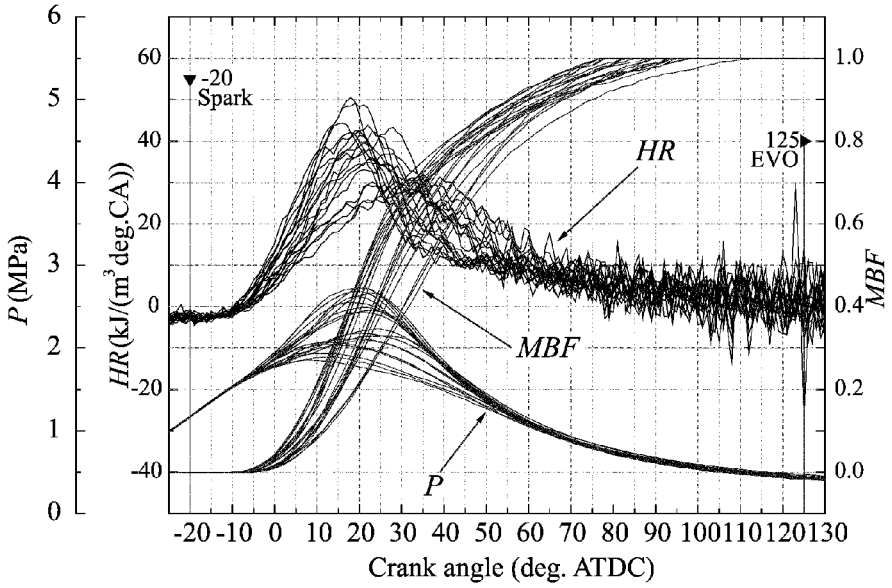
FIG. 5C is a view showing the states of the combustion parameters from start to the steady operation, which are classified into the groups according to the combustion state.

Group 2 (Gr.2) shown by FIG. 5C is grouped between Cycle Nos. 8 to 23 after Gr.1. According to a combustion pattern shown in FIG. 5C, a combustion state in a cycle in which the peak of HR is one is shown.

Figure 5D:
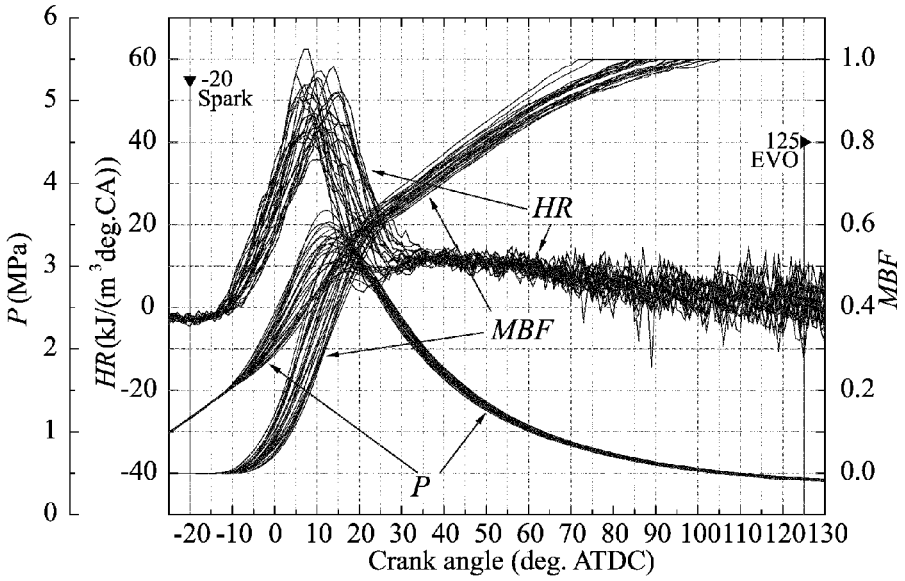
FIG. 5D is a view showing the states of the combustion parameters from start to the steady operation, which are classified into the groups according to the combustion state.

Group 3 (Gr.3) shown by FIG. 5D is obtained by grouping Cycle No. 24 and its subsequent cycles corresponding to the second half of the steady operation state. According to a combustion pattern shown in FIG. 5D, the rate of change of MBF that increases monotonously changes, and a pattern having a hump in the middle of the graph is formed. A combustion state where peaks of HR are two is brought about in a state where such a pattern of MBF is detected.

For example, in the case of the engine shown in the present embodiment, sequential changes from Gr.0 of motoring to Gr.3 are made from the start to the steady operation. In this process, rising of HR to the crank angle becomes steep, $HR_{max}$ becomes large, and $\theta_{HRmax}$ indicating the position of $HR_{max}$ moves toward the TDC side. The cylinder pressure P approaches TDC according to the movement of the pattern of HR toward to the TDC side, the peak value $P_{max}$ becomes high, and $\theta_{Pmax}$ showing the position of $P_{max}$ tends to approach TDC.

Next, the combustion images captured in synchronization with the measurement of the cylinder pressure will be described with reference to FIGS. 6A to 6D and FIG. 7.

FIGS. 6A to 6D are views showing the combustion images captured in synchronization with the measurement of the cylinder pressure. Three combustion images with different timings in the same cycle are shown in FIGS. 6A to 6D, respectively.

Figure 6A:
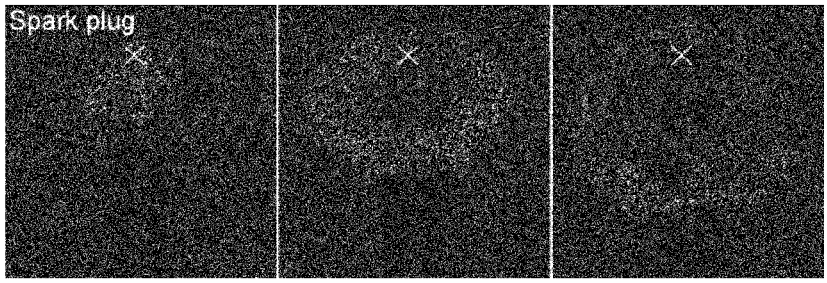
FIG. 6A is a view showing combustion images captured in synchronization with measurement of cylinder pressure.
Figure 6B:
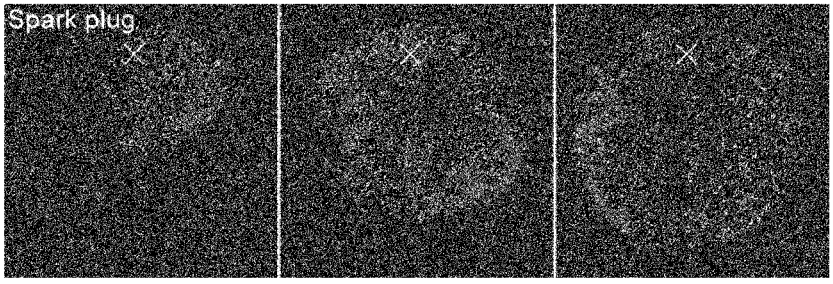
FIG. 6B is a view showing combustion images captured in synchronization with the measurement of the cylinder pressure.
Figure 6C:
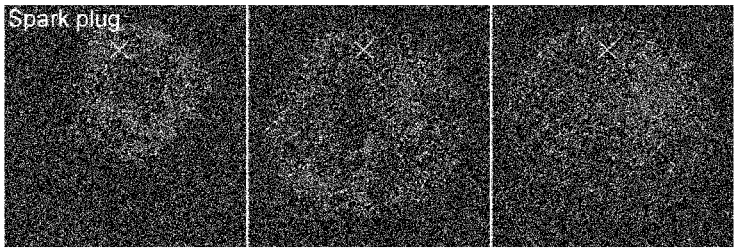
FIG. 6C is a view showing combustion images captured in synchronization with the measurement of the cylinder pressure.
Figure 6D:
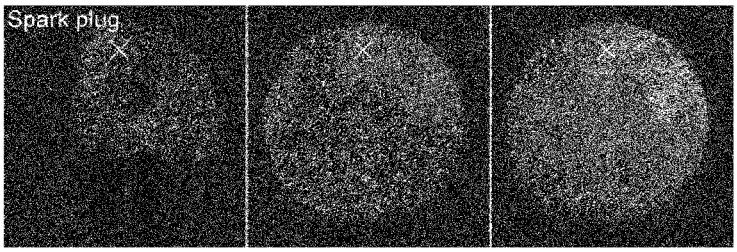
FIG. 6D is a view showing combustion images captured in synchronization with the measurement of the cylinder pressure.
Figure 7:
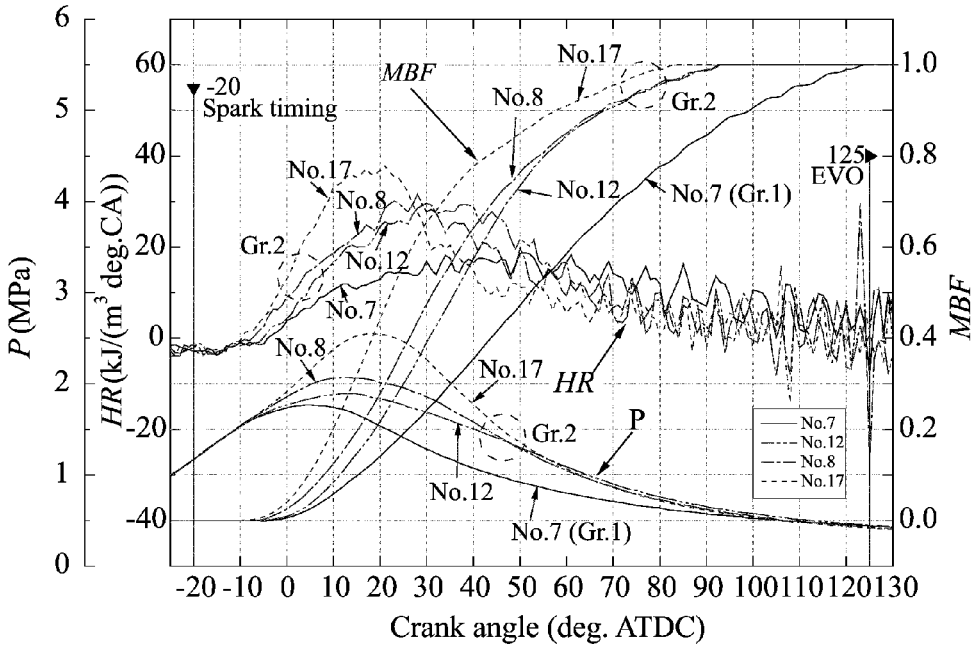
FIG. 7 is a view showing HR and MBF corresponding to the combustion images shown in FIGS. 6A to 6D.

Additionally, FIG. 7 is a view showing HR and MBF according to the combustion images shown in FIGS. 6A to 6D.

FIG. 6A shows combustion images immediately after the start of the firing, and corresponds to the combustion state of Gr.1. Although propagation of blue flames by ignition can be confirmed from the combustion image at the timing of TDC, the area thereof is small and MBF at this time is 0.6%. If ATDC 10 deg. CA is brought about, the blue flame occupies about 60 percent of the observation window, but MBF is 5.8%. Gr.1 is characterized by combustion in which $P_{max}$ is approximately equal to the motoring pressure as mentioned above and $HR_{max}$ is also small. The above combustion images support this.

FIGS. 6B to 6D are combustion images of the combustion state of Gr.2 until IMEP reaches a steady-state value while increasing slowly after IMEP abruptly increases through firing. FIG. 6B (Cycle No. 12) and FIG. 6C (Cycle No. 8) of these take the approximately same IMEP values as shown in these drawings. Nevertheless, the combustion images of FIGS. 6B and 6C are greatly different from each other. It can be understood that the combustion images of FIG. 6C have a wider flame area compared to the combustion images of FIG. 6B even at the same crank angle.

This, as shown in FIG. 7, also corresponds to the rising timing of HR, and the ignition delay in Cycle No. 8 (FIG. 6C) is shorter than that in Cycle No. 12 (FIG. 6B). As a result, $P_{max}$ and the variation ($dP/d\theta$) of P to the crank angle $\theta$ in No. 8 (FIG. 6C) becomes greater those in Cycle No. 12 (FIG. 6B) (Cycle No. 8 (FIG. 6C)>No. 12 (FIG. 6B)). Moreover, a second item $b_2$ of a right-hand side of an operational expression (Expression (2)) that calculates IMEP becomes greater in Cycle No. 8 (FIG. 6C) than in No. 12 (FIG. 6B) (Cycle No. 8 (FIG. 6C)>No. 12 (FIG. 6B)).

Here, since combustion is retarded as a whole from the relationship in which $\theta_{MBF}0.5$ becomes smaller in No. 8 (FIG. 6C) than in Cycle No. 12 (FIG. 6B) (Cycle No. 8 (FIG. 6C)<No. 12 (FIG. 6B)), the cylinder pressure P also becomes smaller in No. 8 (FIG. 6C) than in Cycle No. 12 (FIG. 6B) after ATDC 50 deg. CA (Cycle No. 8 (FIG. 6C)<No. 12 (FIG. 6B)). The above relationship becomes a cause by which a first item $b_1$ of the right-hand side of the operational expression (Expression (2)) that calculates IMEP becomes smaller in No. 8 (FIG. 6C) than in Cycle No. 12 (FIG. 6B) (No. 8 (FIG. 6C)<No. 12 (FIG. 6B)). From the above, when flame propagation speed is slow, $b_1$ increases ($b_1 \rightarrow$increase), $b_2$ decreases ($b_2 \rightarrow$decrease), and when the flame propagation speed is fast, $b_1$ decreases ($b_1 \rightarrow$decrease) and $b_2$ increases ($b_2 \rightarrow$increase). In this way, a state where the IMEP values become approximately equal to each other by the balance of both $b_1$ and $b_2$ is produced.

Meanwhile, in FIG. 6D, a flame occupies about ¼ of the observation window in TDC, and if ATDC 10 deg. CA is brought about, an aspect in which the flame propagates to the outside of the observation window is imagined. ATDC 20 deg. CA at which the whole image is bright approximately corresponds to the crank angle $\theta_{HRmax}$ at which the heat release rate becomes the maximum.

From the above combustion images and combustion analysis results, the relationship between $b_1$ and $b_2$ in the operational expression of IMEP is arranged as the following relationships.

When the flame propagation speed is relatively fast, (A) HR rises sharply (the rate of change of HR becomes large). Additionally, in the above case, (B) $HR_{max}$ that is a peak value of HR becomes large. Additionally, in the above case, (C) a position (crank angle) indicating the peak of HR approaches TDC. Additionally, in the above case, (D) $P_{max}$, $dP/d\theta$, and $b_1$ and $b_2$ become large, respectively. In short, it is shown that the patterns of HR and MBF have any influence on frequency components includes in a waveform (cylinder pressure waveform) showing a change in the cylinder pressure according to the tendencies shown the above (A) to (D).

(Relation Between Amplitude of Frequency Component of Cylinder Pressure Waveform, and Crank Angle at which MBF Becomes Predetermined Value)

Next, the relationship between the amplitudes of frequency components of a cylinder pressure waveform and a crank angle (MBF timing $\theta_{MBF}$) at which MBF becomes a predetermined value will be described with reference to FIGS. 8 to 12.

In the following description, for example, MBF at which the crank angle reaches 30% is represented as $\theta_{MBF}0.3$. Additionally, $\theta_{MBF}0.3$ corresponding to the ignition timing, $\theta_{MBF}0.7$ corresponding to the end timing of combustion duration, and $\theta_{MBF}0.5$ according to intermediate timing between the ignition timing and the end timing of the combustion duration and corresponding to the end timing of the first half of the combustion duration is selected as central values of the MBF timing $\theta_{MBF}$.

Figure 8:
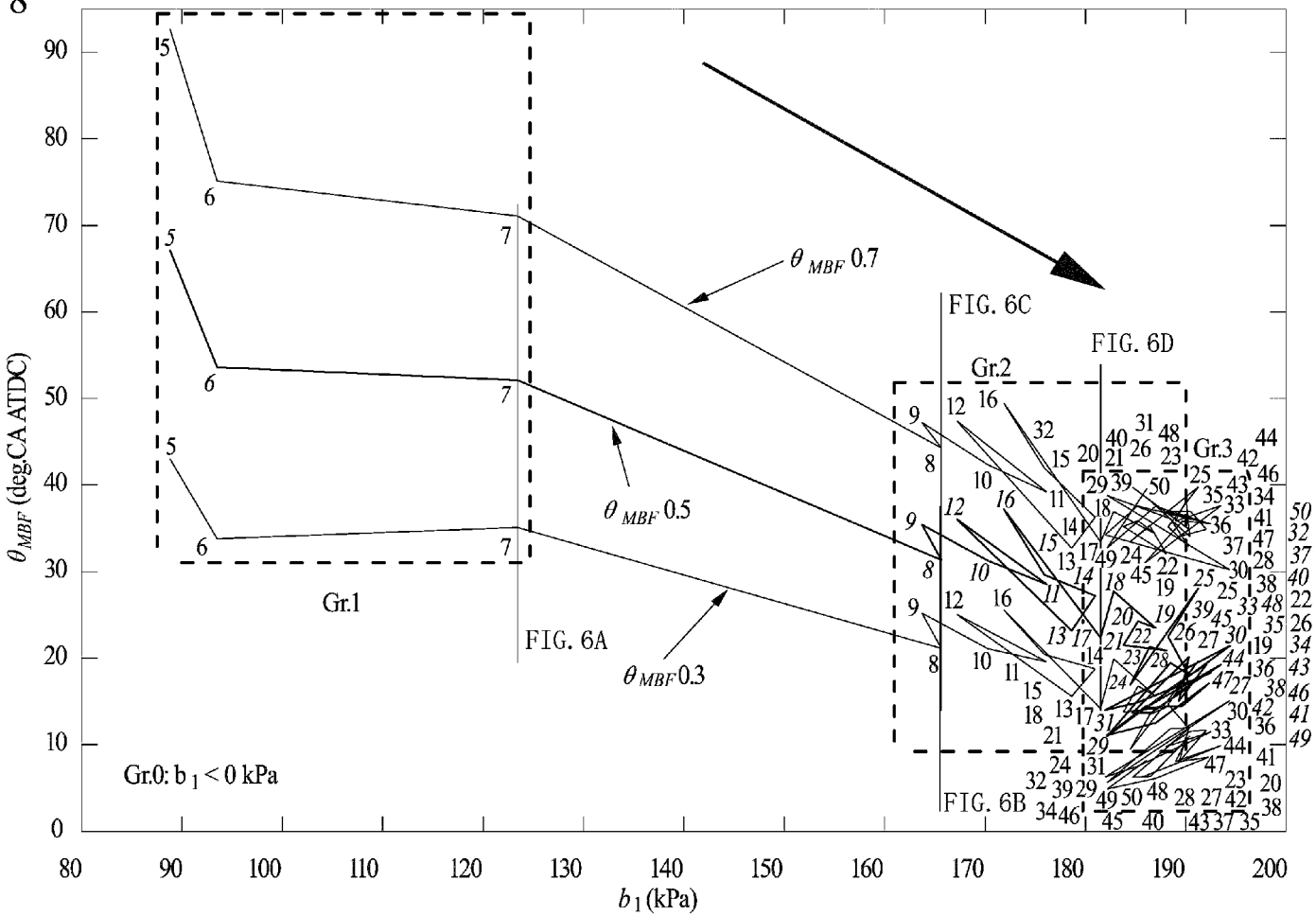
FIG. 8 is a view showing the relationship between the amplitude of a fundamental wave and MBF timing $\theta_{MBF}$ at the start time.

First, FIG. 8 is a view showing the relationship between the amplitude $b_1$ (the fundamental wave amplitude $b_1$ of the first item of the right-hand side of the IMEP operational expression (the aforementioned Expression (2))) (horizontal axis) of the fundamental wave and the MBF timing $\theta_{MBF}$ (vertical axis), at the start time. Numbers attached to polygonal line graphs showing respective MBF timings $\theta_{MBF}$ shown in FIG. 8 are cycle numbers. As the cycle numbers increase (as the cycles proceeds), a state shifts in the direction of an arrow shown in FIG. 8. According to the direction of the arrow shown in FIG. 8, a tendency in which $b_1$ increases and $\theta_{MBF}$ decreases is shown. Additionally, in the duration (from Gr.2 to Gr.3) excluding Gr.1 immediately after the start of the firing shown in FIG. 8, there is little change in the amplitude $b_1$ of the fundamental wave. Additionally, in this duration, the correlation between $b_1$ and $\theta_{MBF}$ is low. In addition, a $b_k$ position (in this case, $b_1$) when the combustion images shown in the aforementioned FIGS. 6A to 6D are captured is written in this drawing. The same applies for the following views.

Next, the relationship between the amplitude of the secondary harmonic wave and MBF timing $\theta_{MBF}$ (vertical axis) at the start time will be described with reference to FIG. 9.

Figure 9:
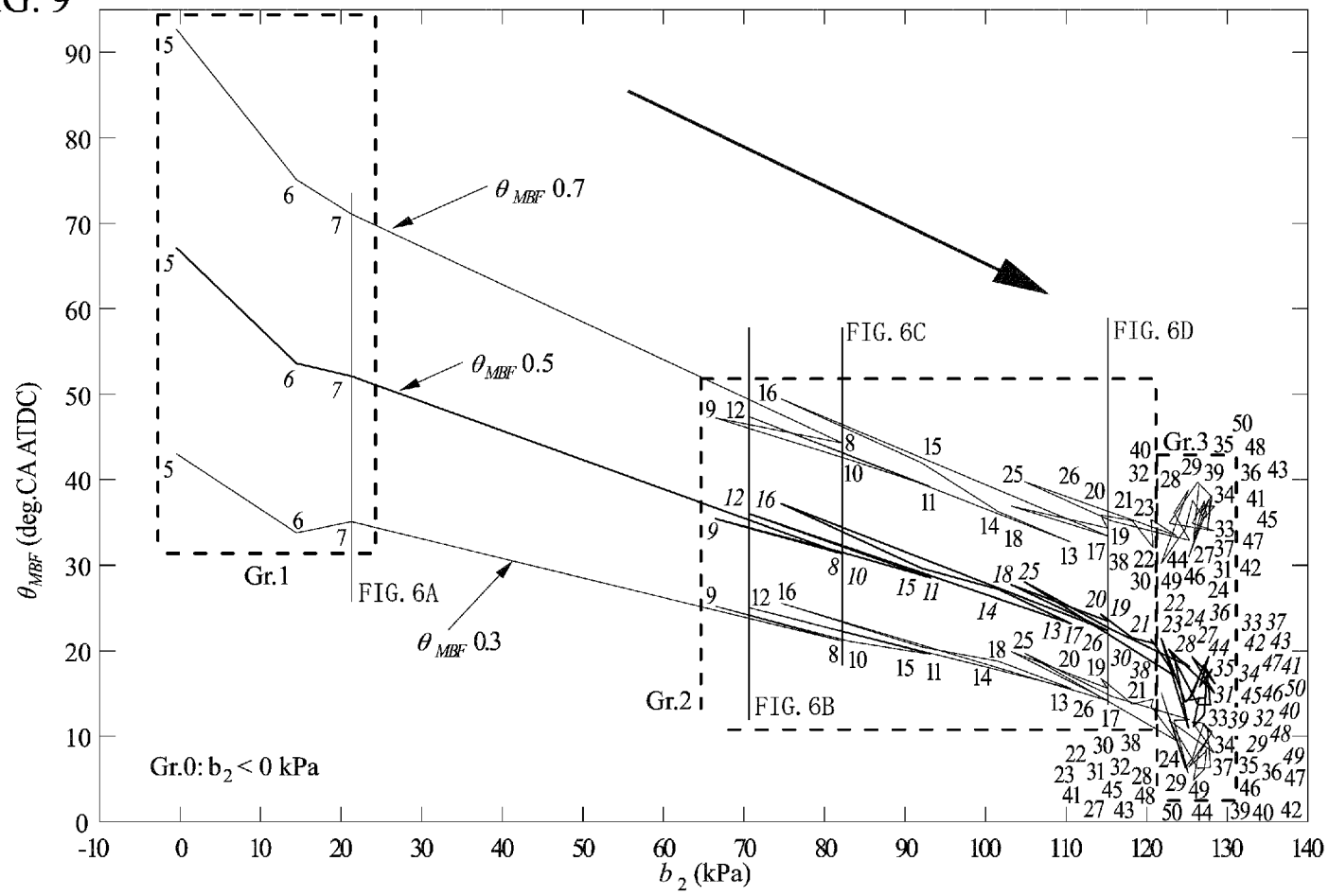
FIG. 9 is a view showing the relationship between the amplitude of a secondary harmonic wave and the MBF timing $\theta_{MBF}$ at the start time.

FIG. 9 is a view showing the relationship between the amplitude $b_2$ (the fundamental wave amplitude $b_2$ of the second item of the right-hand side of the IMEP operational expression (the aforementioned Expression (2))) (horizontal axis) of the secondary harmonic wave and the MBF timing $\theta_{MBF}$ (vertical axis), at the start time. It can be understood from polygonal line graphs of the MBF timing $\theta_{MBF}$ shown in FIG. 9 that there is a tendency different from the aforementioned FIG. 8. In FIG. 9, a range (the range of Gr.2 distributed in a range where $b_1$ is equal to or more than 160) where, in the aforementioned FIG. 8, the polygonal line graphs of the MBF timing $\theta_{MBF}$ overlap each other and distinction is difficult, spreads in the direction of the horizontal axis and the correlation with $\theta_{MBF}$ is clear. Additionally, the classification of the combustion patterns are allowed on the basis of the magnitude of $b_2$.

For example, two threshold values (20 kPa and 120 kPa) that determine the magnitude of $b_2$ are determined, and the groups of the combustion patterns are determined on the basis of the magnitude of $b_2$. When a range of $b_2$<20 kPa, the combustion pattern is classified as Gr.0 and Gr.1. When a range of $b_2$>120 kPa, the combustion pattern is classified as Gr.3. When a range of $20 \leq b_2 \leq 120$, the combustion pattern is classified as Gr.2.

Additionally, since this engine shows a tendency in which $\theta_{MBF}0.3$ to $\theta_{MBF}0.7$ decrease together with $b_2$ until $b_2$ reaches 120 kPa, both of the ignition delay and the combustion duration become short. On the other hand, if $b_2$ exceeds 120 kPa, there is a tendency in which $\theta_{MBF}0.3$ and $\theta_{MBF}0.5$ decreases, but $\theta_{MBF}0.7$ increase instead. In a region where $b_2$ exceeds 120 kPa, it can be determined that the ignition delay becomes short, but the combustion duration becomes long.

Next, cases of the third to fifth harmonic waves will be described with reference to FIGS. 10 to 12.

Figure 10:
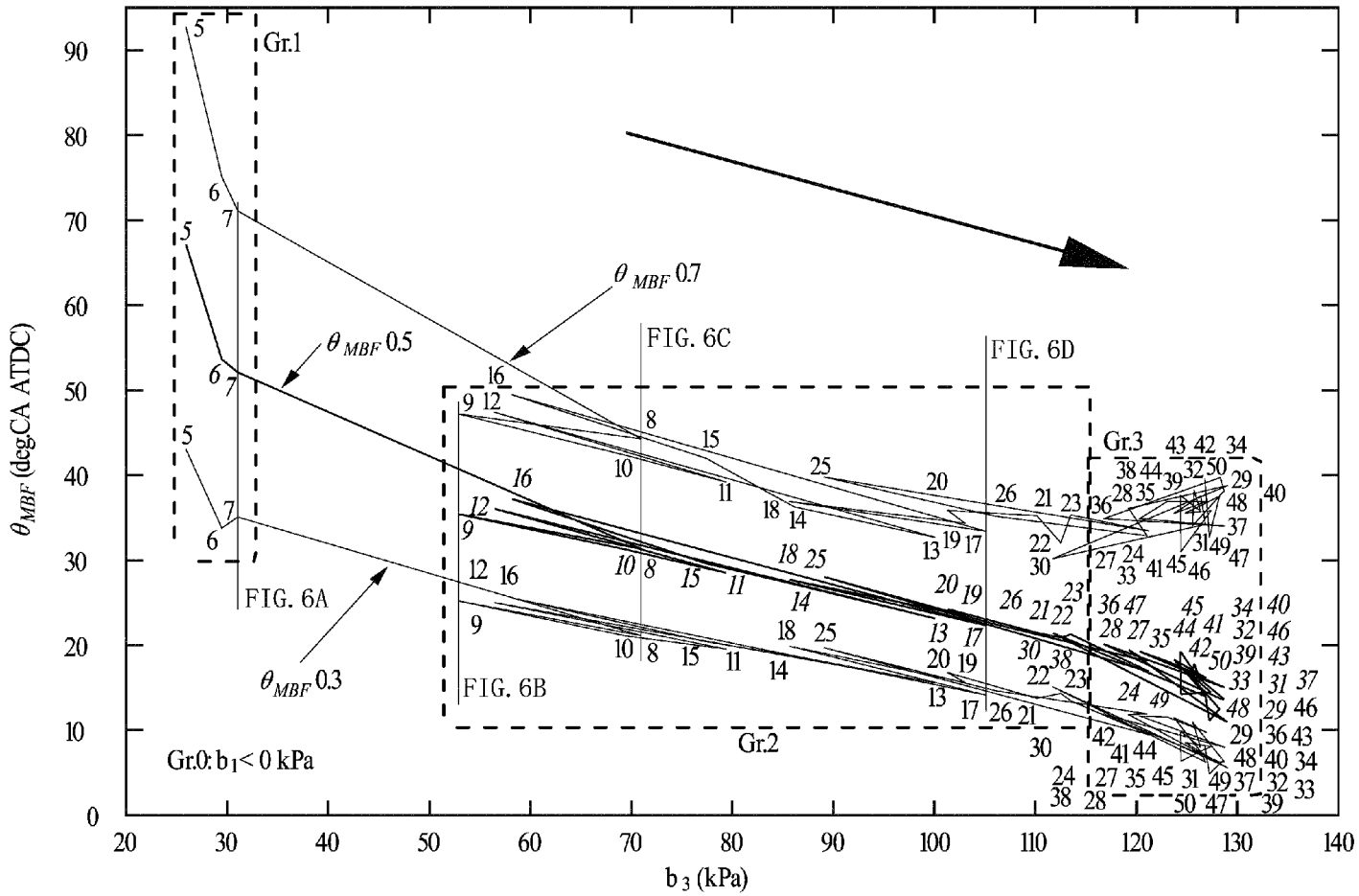
FIG. 10 is a view showing the relationship between the amplitude of a third harmonic wave and the MBF timing $\theta_{MBF}$ at the start time.
Figure 11:
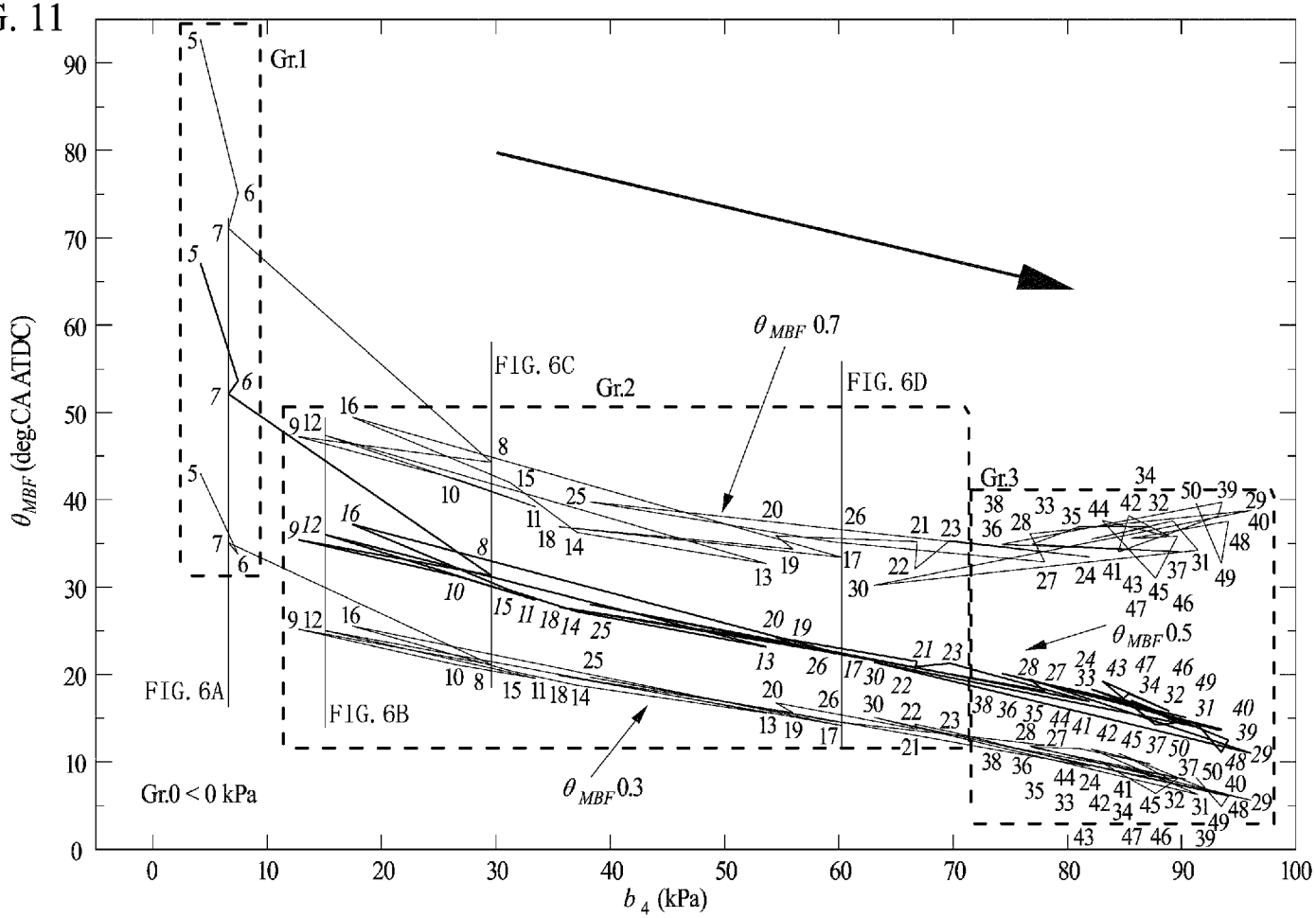
FIG. 11 is a view showing the relationship between the amplitude of a fourth harmonic wave and the MBF timing $\theta_{MBF}$ at the start time.
Figure 12:
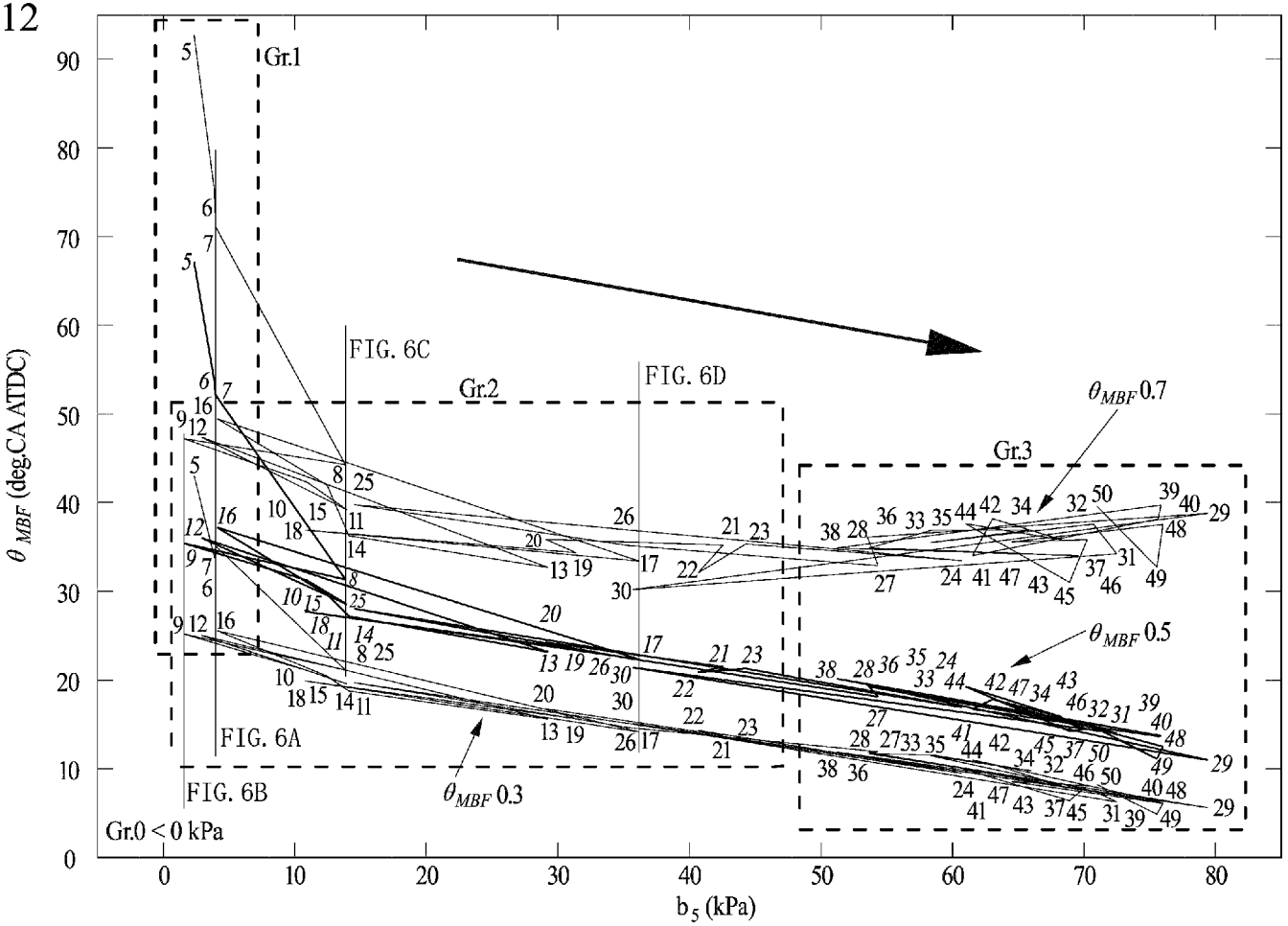
FIG. 12 is a view showing the relationship between the amplitude of a fifth harmonic wave and the MBF timing $\theta_{MBF}$ at the start time.

FIGS. 10 to 12 are view showing analysis results regarding the amplitudes of the third to fifth harmonic waves at the start time, respectively.

Incidentally, in the case of IMEP, it can be confirmed that there is a correlation depending on the components of the fundamental wave and the secondary harmonic wave (refer to Japanese Unexamined Patent Application, First Publication No. 2010-261370D). The third to fifth harmonic wave components to be described here hardly have any influence on the value of IMEP.

On the other hand, in the case of MBF timing $\theta_{MBF}$, as shown in the aforementioned FIGS. 8 and 9, when the order is low (in the case of the fundamental wave and the secondary harmonic wave), a range (particularly Gr.3) where the polygonal line graph of the MBF timing $\theta_{MBF}$ overlaps a lump is produced.

Moreover, the amplitudes of the third to fifth harmonic waves are analyzed regarding the MBF timing $\theta_{MBF}$. As a result, when the order is low, it can be understood that, in the range (particularly Gr.3) where the polygonal line graphs of the MBF timing $\theta_{MBF}$ overlap the lump, the relationship between $b_k$ and $\theta_{MBF}$ becomes clear as the order of the harmonic waves is increased from 3 to 5, and mutual correlation is easily distinguished.

Additionally, the classification of the combustion patterns according to the magnitude of $b_3$ to $b_5$ is also allowed by the same method as $b_2$.

As shown in the above-described FIGS. 8 to 12, a clear proportional relationship is recognized between the amplitude $b_k$ of the harmonic waves and the MBF timing $\theta_{MBF}$. Detection of the MBF timing $\theta_{MBF}$ is allowed by operation processing based on this proportional relationship without depending on means called the combustion analysis.

(Influence that Harmonic Wave Order k has on Correlation with MBF Timing $\theta_{MBF}$)

Figure 13:
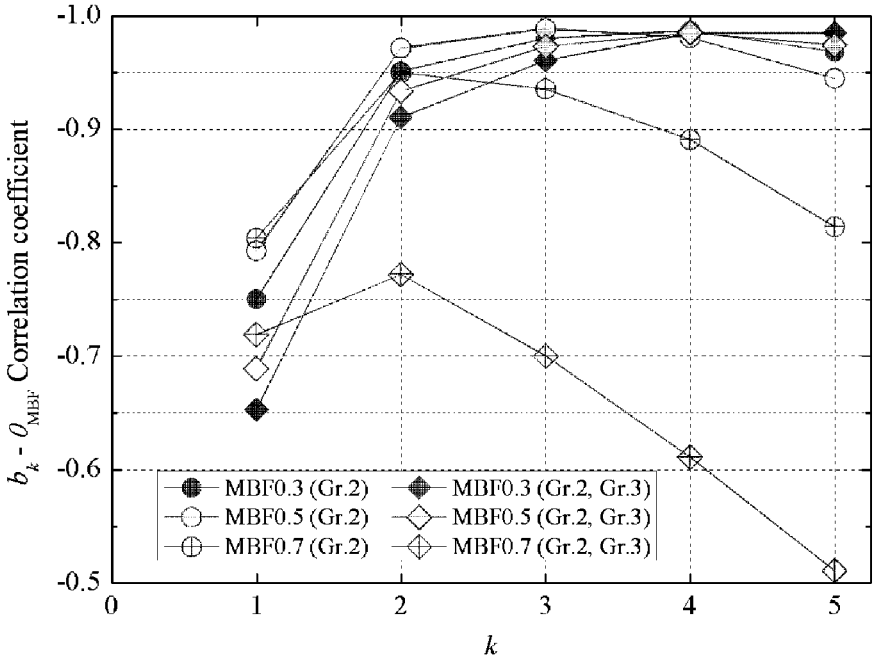
FIG. 13 is a view showing the correlation between a harmonic wave order k and the MBF timing $\theta_{MBF}$ at the start time.

Any influence that the harmonic wave order k has on the correlation with the MBF timing $\theta_{MBF}$ will be described with reference to FIG. 13. FIG. 13 is a view showing the correlation between the harmonic wave order k and the MBF timing $\theta_{MBF}$ at the start time. FIG. 13 shows the correlation between two cases including a case where a correlation coefficient is only combustion pattern Gr.2, and a case where Gr.2 and Gr.3 are combined. The correlation between the harmonic wave order k and the MBF timing $\theta_{MBF}$ is generally higher in the case of only Gr.2. Additionally, respective correlation coefficients between the harmonic wave order k, and $\theta_{MBF}0.3$ and $\theta_{MBF}0.5$ show values nearer −1 than −0.9 in a range where k is 2 to 5, and show a strong negative correlation. Additionally, when the order is a fourth order (k=4), the correlation coefficient shows −0.99 and shows the strongest negative correlation. The reason why the correlation becomes weak in the case of $\theta_{MBF}0.7$ is because the value of $\theta_{MBF}0.7$ tends to change from decrease to increase in a region where the value of $b_k$ is large. This tendency causes deterioration of linearity.

As shown above, there is a high correlation between the amplitudes $b_2$ to $b_5$ of the secondary to fifth harmonic wave components included in the cylinder pressure waveform with the rotational frequency of the crankshaft as the fundamental frequency and the timings ($\theta_{MBF}0.3$, $\theta_{MBF}0.5$, $\theta_{MBF}0.7$) at which MBF becomes 30%, 50%, and 70%. Additionally, the classification of the combustion patterns, that is, the patterns of the heat release rate and the mass burn fraction, is allowed depending on the magnitude of the amplitudes of the respective harmonic wave components.

The combustion characteristics at the start time are shown in the above-described embodiment.

[Study of Combustion Characteristics when Acceleration/Deceleration Operation is Performed]

Subsequently, the combustion characteristics obtained when the engine performs an acceleration/deceleration operation will be described with reference to FIGS. 14 to 38.

The characteristics of the patterns of the heat release rate and the mass burn fraction are arranged to clarify the relationship with the Wiebe function through the same method as that at the time of the aforementioned start (reference materials: "Fuel Injection and Combustion of Diesel Engine" written by Gyorgy Sitkei (joint-translated by Tameo Tsubouchi and Kiyoo Kato), Asakura Bookstore).

Moreover, a method of estimating MBF0.5 timing without using the technique called the combustion analysis is shown by observing the magnitude of the amplitudes of the secondary to fifth harmonic wave components included in the cylinder pressure waveform.

Hereinafter, a description will be made according to the aforementioned order.

(Comparison with Identification Result by Wiebe Function of MBF Calculation Value)

Even when the engine performs an acceleration/deceleration operation, the aforementioned Expressions (2) to (5) are considered to be similar at the start time. Moreover, the MBF calculation value by Expression (5) can be approximated according to the expression of the Wiebe function shown in the following Expressions (6).

[Expression 7]

$$MBF_W = 1 - \exp(-ax^{(m+1)}) \quad (6)$$

$$\text{where } x = \frac{\theta - \theta_s}{\theta_e - \theta_s}$$

a, m: Coefficients of Wiebe function

θ: Arbitrary crank angle during combustion duration

θs, θe: Crank angle of ignition and combustion end

In addition, when the MBF calculation value according to Expression (5) is expressed in the form of Expression (6), a timing at which $MBF_W$=0.999 is regarded as combustion end timing (x=1), and a=6.908 is obtained.

First, a verification experiment performed for describing the principle in the present embodiment will be described. A general-purpose four-cycle engine is used for this verification experiment. In various types of measurement shown below, an acceleration/deceleration operation is performed while the rotation speed NE (crank rotation speed) of the crankshaft 11 is 900 rpm to 2400 rpm by changing the opening degree of the throttle valve 18 up to ¼ to ¾.

The cylinder pressure is measured in continuous 300 cycles at intervals of 1 deg. CA in synchronization with the crankshaft rotation angle by the pressure sensor (not shown) and the charge amplifier (not shown) that are provided at the combustion chamber 8 for the experiment. The respective amounts shown in the previous Expressions (2) to (6) are obtained from the measured cylinder pressure P. Here, the maximum cylinder pressure $P_{max}$, and the crank angles $\theta_{Pmax}$ and $\theta_{MBF}$ are calculated by the secondary interpolation from values at every 1 deg. CA.

(Changes in $P_{max}$, $\theta_{Pmax}$, and IMEP in Acceleration/Deceleration Operation)

Figure 14:
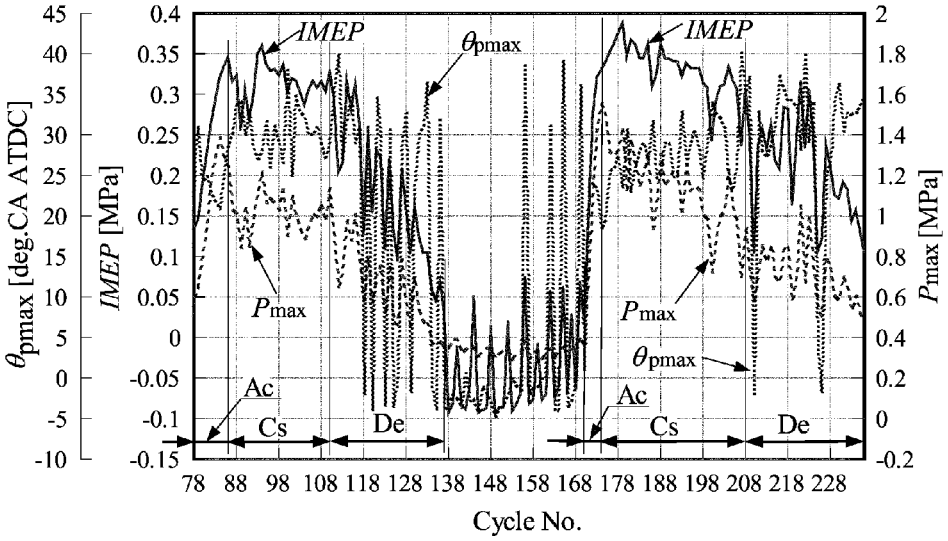
FIG. 14 is a view showing $P_{max}$, $\theta_{Pmax}$, and IMEP calculated from the cylinder pressure measured during an acceleration/deceleration operation.

FIG. 14 is a view showing $P_{max}$, $\theta_{Pmax}$, and IMEP calculated from the cylinder pressure measured during the acceleration/deceleration operation. FIG. 14 shows changes in $P_{max}$, $\theta_{Pmax}$, and IMEP while Cycle Nos. 78 to 236 equivalent to about 2 cycles of the acceleration/deceleration operation are extracted from the cylinder pressure measured in the continuous 300 cycles. In FIG. 14, Ac, Cs, and De represent the rough ranges of operation periods for acceleration, constant speed, and deceleration. The acceleration operation duration Ac shows a duration in which an acceleration operation is performed in which the rotating speed is increasing from 900 rpm to 2400 rpm by setting the throttle opening degree from ¼ to ¾. The constant-speed operation duration Cs shows duration in which a constant speed operation adjusted so that the throttle opening degree is ¾ and the rotating speed becomes approximately constant at 2400 rpm is performed. The deceleration operation duration De shows duration in which a deceleration operation is performed in which the rotating speed is decreased from 2400 rpm to 900 rpm by changing the throttle opening degree from ¾ to ¼.

From FIG. 14, IMEP, $P_{max}$, and $\theta_{Pmax}$ increase gradually in the acceleration operation duration Ac. If entry into the constant-speed operation duration Cs is allowed, $P_{max}$ declines and fluctuated with a certain width together with IMEP and $\theta_{Pmax}$. In the deceleration operation duration De, these tend to decrease while fluctuating.

In the following, Cycle Nos. 78 to 86, Nos. 87 to 110, and Nos. 111 to 137 are mainly selected, respectively, as analyzed targets of the operation periods for acceleration, constant speed, and deceleration, from a total range (Cycle Nos. 78 to 137) including the operation periods for acceleration, constant speed, and deceleration.

(Changes in Cylinder Pressure, Heat Release Rate, and MBF During Acceleration/Deceleration Operation Duration)

Changes in the ignition delay, the combustion duration, and IMEP during the acceleration/deceleration operation duration will be described with reference to FIGS. 15 to 18.

Figure 15:
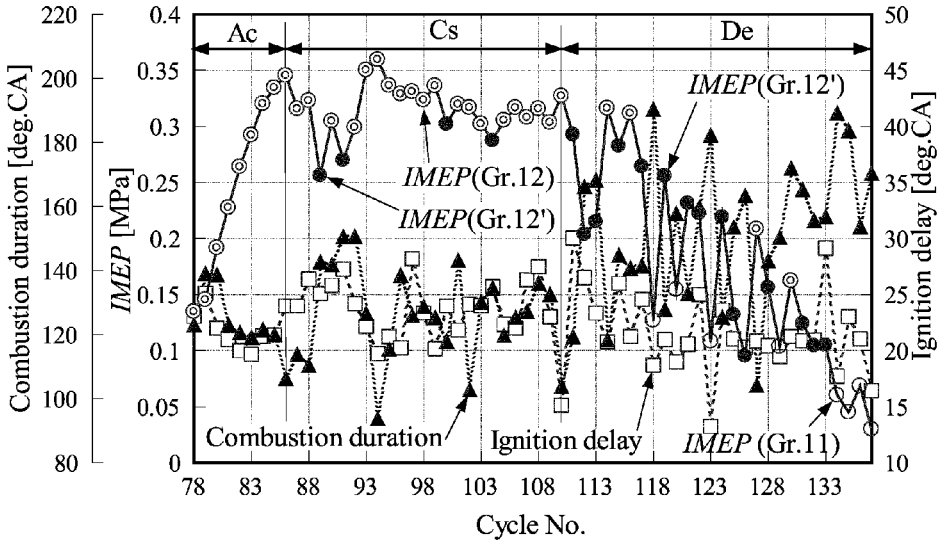
FIG. 15 is a view showing changes in ignition delay, combustion duration, and IMEP during acceleration/deceleration operation duration.

FIG. 15 is a view showing the changes in the ignition delay, the combustion duration, and IMEP during the acceleration/deceleration operation duration. From FIG. 15, the ignition delay and the combustion duration show the same change tendency when the acceleration or constant speed operation is performed, and there is a tendency in which the combustion duration becomes short if the ignition delay (time) becomes small, however, in contrast, the combustion duration also becomes long if the ignition delay (time) becomes large. If entry into the deceleration operation is allowed, the combustion duration is long particularly when the fluctuation of IMEP is large.

Figure 16:
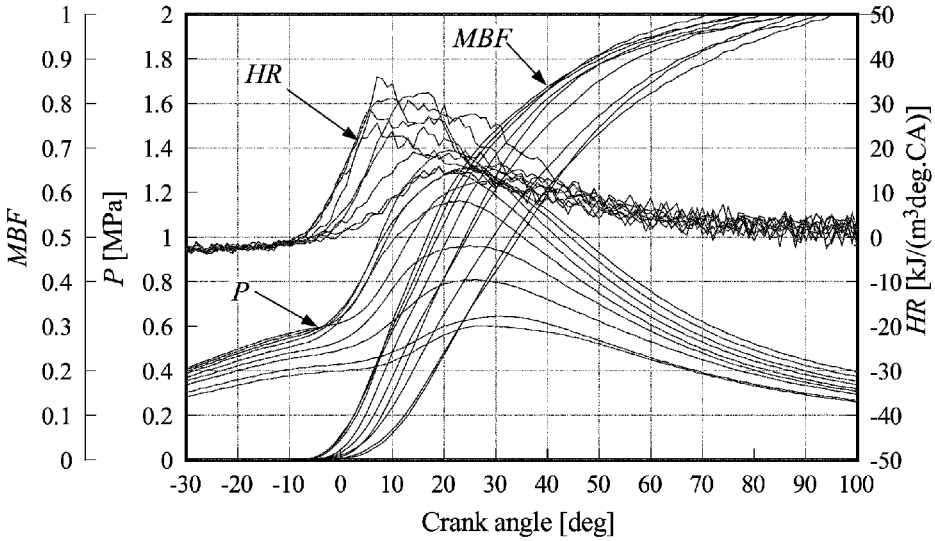
FIG. 16 is a view showing the results obtained when the cylinder pressure P, HR, and MBF in a complete cycle during acceleration operation duration are overwritten.

FIG. 16 is a view showing the results obtained when the cylinder pressure P, HR, and MBF in a complete cycle during the acceleration operation duration are overwritten. As are shown in FIG. 16, there is a tendency in which $P_{max}$ and $HR_{max}$ begin to increase as the numbers of cycles are overlapped and the crank angle position $\theta_{HRmax}$ at the time of $HR_{max}$ approaches TDC.

Figure 17:
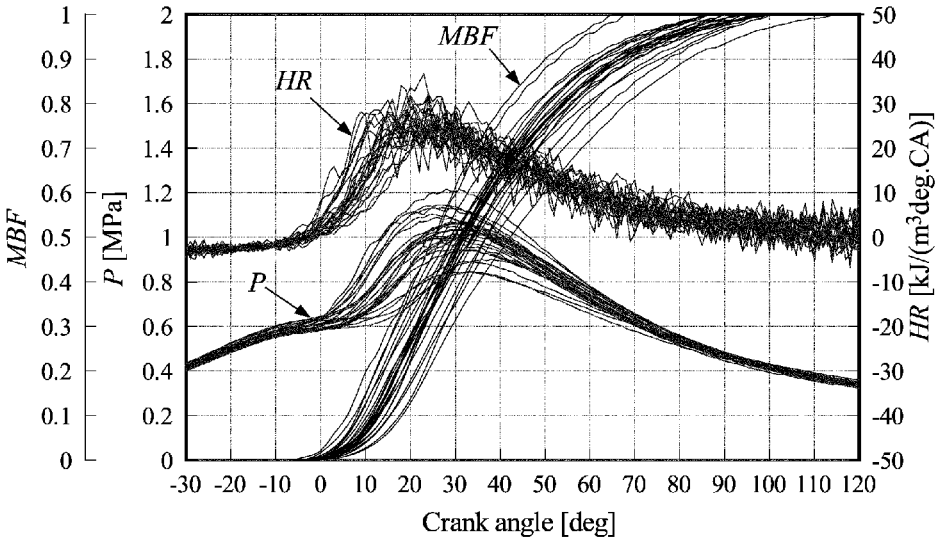
FIG. 17 is a view showing the results obtained when the cylinder pressure P, HR, and MBF in the complete cycle during constant-speed operation duration are overwritten.

FIG. 17 is a view showing the results obtained when the cylinder pressure P, HR, and MBF in the complete cycle during the constant-speed operation duration are overwritten. As shown in FIG. 17, if entry into the constant-speed operation duration is allowed, the fluctuation of HR is recognized, but the patterns thereof are approximately the same.

Figure 18:
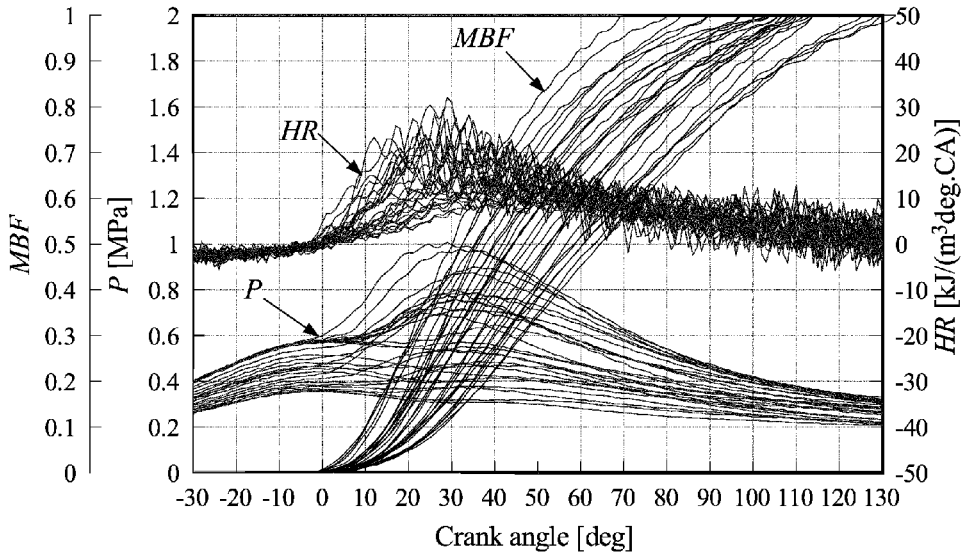
FIG. 18 is a view showing the results obtained when the cylinder pressure P, HR, and MBF in the complete cycle during deceleration operation duration are overwritten.

FIG. 18 is a view showing the results obtained when the cylinder pressure P, HR, and MBF in the complete cycle during the deceleration operation duration are overwritten. As shown in FIG. 18, in the deceleration operation duration, fluctuations in P, HR, and MBF are large, and a cycle in which two-peak combustion having two peaks in P occurs can also be seen.

(Relation Between Grouping of Combustion Patterns and Operational State)

The relationship between the grouping of the combustion patterns and an operational state will be described with reference to FIGS. 19 to 23. The groups of the combustion patterns during the acceleration/deceleration operation including constant speed are classified from the shape of the above cylinder pressure waveform and the above waveforms of HR and MBF. The combustion patterns are determined by the same method as the aforementioned method at the start time.

Figure 19:
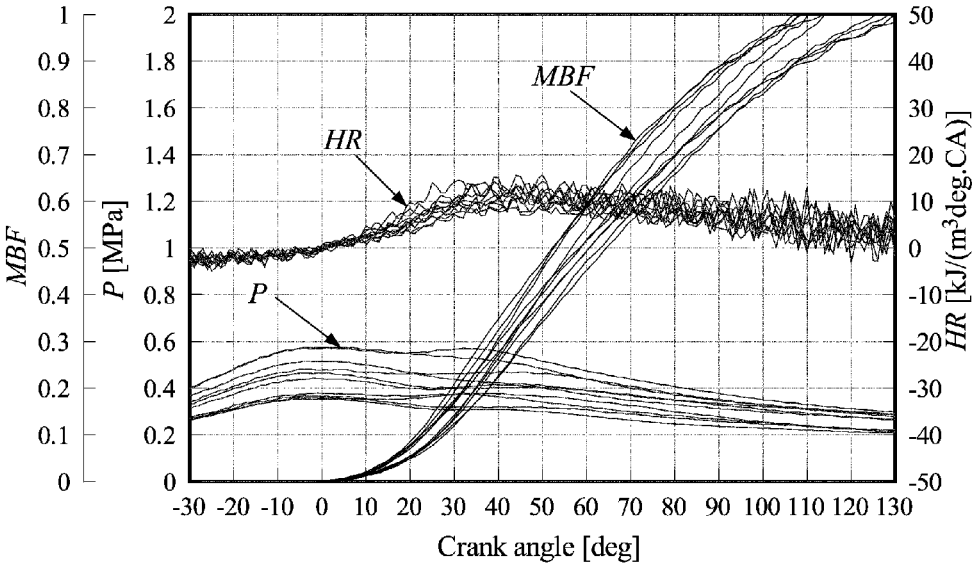
FIG. 19 is a view showing a combustion pattern Gr.11 from which two peaks can be observed in the cylinder pressure P.

FIG. 19 is a view showing a combustion pattern in which two peaks (peak values) can be observed in the cylinder pressure P. The combustion pattern shown in FIG. 19 is classified as a combustion pattern of Group 11 (hereinafter referred to as Gr.11).

Figure 20:
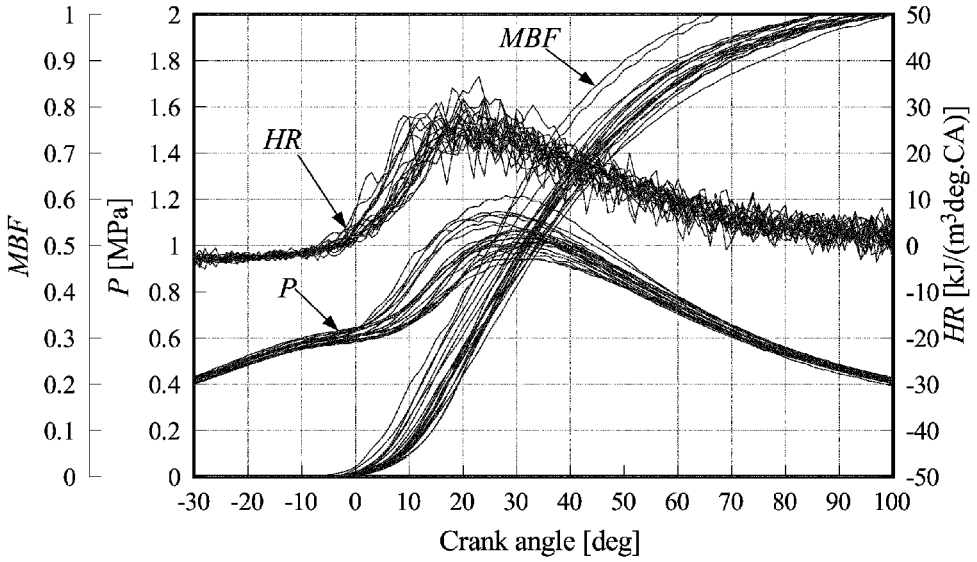
FIG. 20 is a view showing a combustion pattern Gr.12 in which fluctuations in patterns of a cylinder pressure waveform, a heat release rate HR, and MBF are small and from which one peak can be observed in HR.

FIG. 20 is a view showing a combustion pattern in which fluctuations in patterns of the cylinder pressure waveform, the heat release rate HR, and MBF are small and from which one peak (peak value) can be observed in HR. The combustion pattern shown in FIG. 20 is classified as a combustion pattern of Group 12 (hereinafter referred to as Gr.12).

Figure 21:
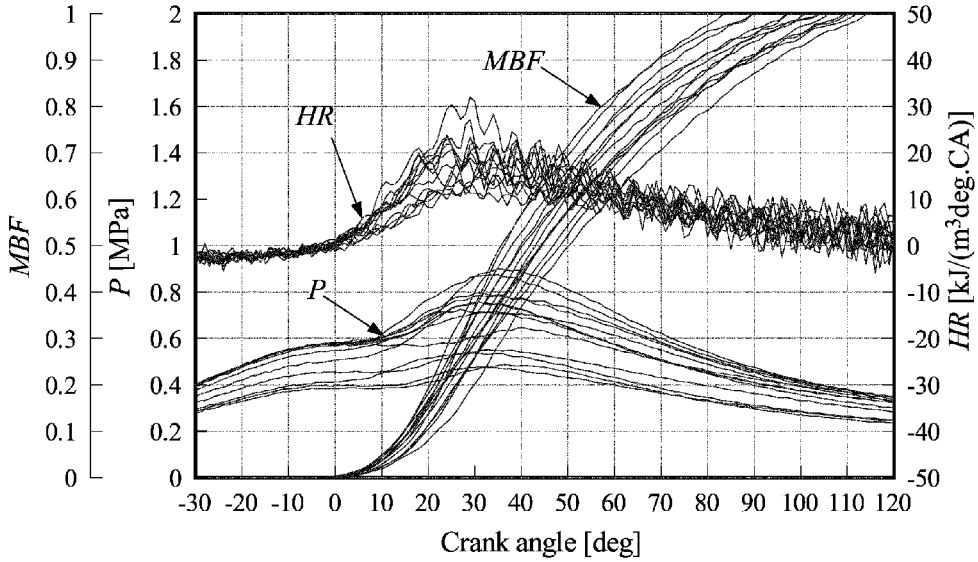
FIG. 21 is a view showing a combustion pattern Gr.12' from which a flat portion can be observed in the cylinder pressure P after TDC.

FIG. 21 is a view showing a combustion pattern from which a flat portion can be observed in the cylinder pressure P after TDC. The combustion pattern shown in FIG. 21 is classified as a combustion pattern that appears when shift is made from Gr.11 to Gr.12, and is referred to as a combustion pattern of Group 12' (hereinafter referred to as Gr.12') herein. As for the combustion patterns under respective operating conditions, the combustion pattern of only Gr.12 is observed in the acceleration operation duration, the combustion patterns of Gr.12 and Gr12' are observed in the constant-speed operation duration, and the combustion patterns including all of Gr.11, Gr.12 and Gr.12' are observed in the deceleration operation duration.

Information on the combustion patterns classified herein is shown on the graph (IMEP graph) showing a change in IMEP, which is shown in the aforementioned FIG. 15. In the acceleration operation duration Ac, only the combustion pattern of Gr.12 (double circle) is shown, and in the constant-speed operation duration Cs, the combustion pattern of Gr.12' (filled circle) is shown at valley portions of the IMEP graph and the combustion pattern of Gr.12 (double circle) are shown at the other portions. Additionally, in the deceleration operation duration De, the fraction of the combustion pattern of Gr.12' (filled circle) increases, and the combustion pattern of Gr.11 (open circle) is shown at valley portions where the value of IMEP declines greatly.

Here, the results obtained when the mass burn fraction MBF is approximately identified by the Wiebe function regarding the above-described three combustion patterns (Gr.11, Gr.12, and Gr.12') will be described with reference to FIG. 22.

Figure 22:
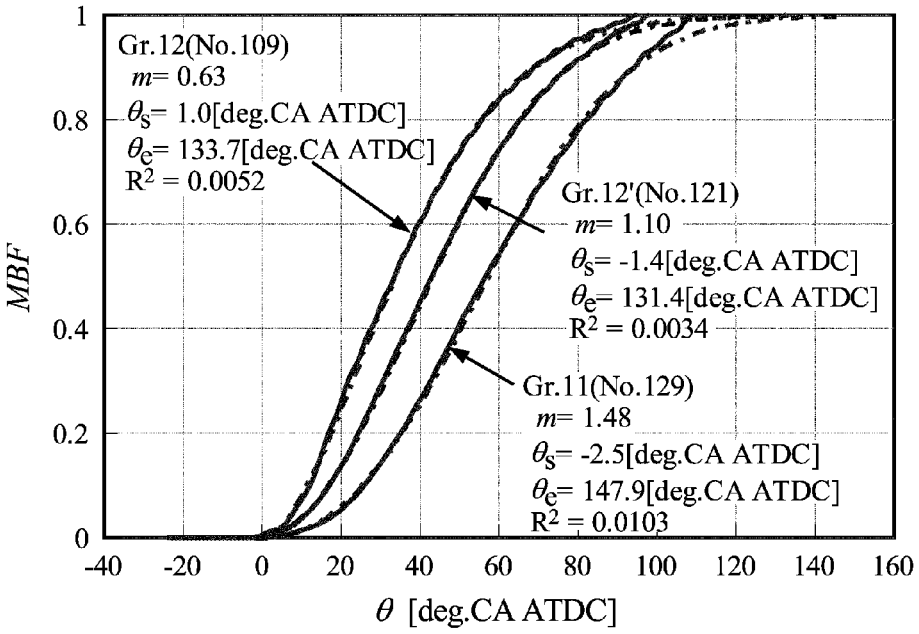
FIG. 22 is a view showing the results obtained when the mass burn fraction MBF is approximately identified by the Wiebe function.

FIG. 22 is a view showing the results obtained when the mass burn fraction MBF is approximately identified by the Wiebe function. Although a slight difference is recognized between the calculation value MBF according to Expression (5) and $MBF_W$ approximated to the Wiebe function in the region of MBF>0.9 from FIG. 22, these coincide with each other well in the other regions. Additionally, since a residual sum-of-squares $R^2$ is equal to or less than 0.02, it can be understood that the accuracy of approximation to the illustrated Wiebe function is also excellent. Additionally, in the case of the example shown in FIG. 22, m (coefficient of Wiebe function)=1.48 in the combustion pattern Gr.11, m=0.63 in the combustion pattern Gr.2, and m becomes an intermediate value (m=1.10) between both in the combustion pattern Gr.12'. It can be understood from these that the magnitude of the coefficient m of the Wiebe function has any influence on a peak value $HR_{max}$ of the heat release rate, and if m becomes large, $HR_{max}$ decreases.

Next, the relationship between the coefficient m of the above-mentioned Wiebe function, and crank angles $\theta_{MBF}0.3$, $\theta_{MBF}0.5$, and $\theta_{MBF}0.7$ at which the mass burn fraction MBF of Expression (5) shows 30%, 50%, and 70% will be described with reference to FIG. 23.

Figure 23:
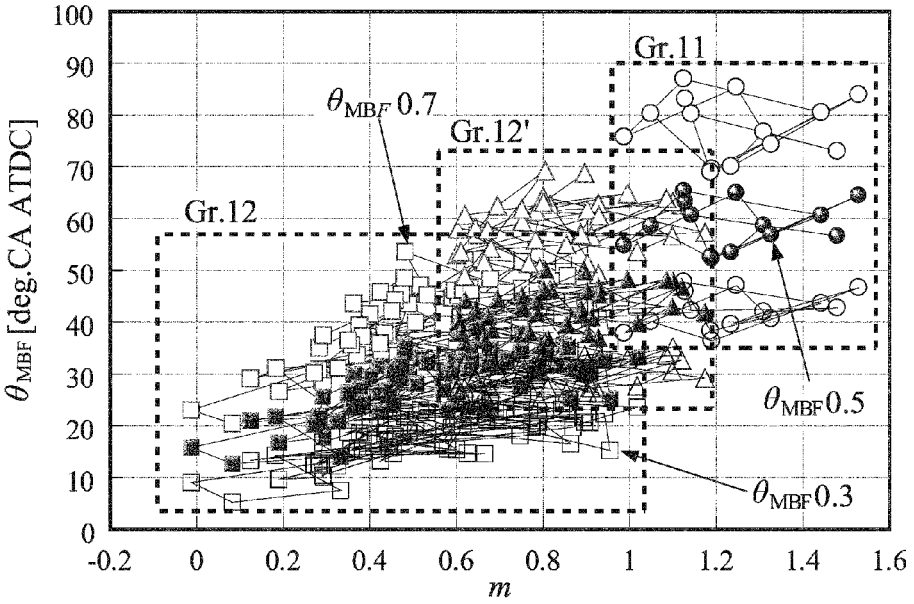
FIG. 23 is a view showing the relationship between a coefficient m of the Wiebe function, and crank angles $\theta_{MBF}$ 0.3, $\theta_{MBF}$ 0.5, and $\theta_{MBF}$ 0.7 at which the mass burn fraction MBF of Expression (5) shows 30%, 50%, and 70%.

FIG. 23 is a view showing the relationship between a coefficient m of the above-mentioned Wiebe function, and crank angles $\theta_{MBF}0.3$, $\theta_{MBF}0.5$, and $\theta_{MBF}0.7$ at which the mass burn fraction MBF of Expression (5) shows 30%, 50%, and 70%. It can be confirmed from FIG. 23 that $\theta_{MBF}0.3$, $\theta_{MBF}0.5$, and $\theta_{MBF}0.7$ increase together with m. Additionally, as mentioned above, when a case where m is small is the combustion pattern Gr.12, a case where m is large is the combustion pattern Gr.11, and a case where m is an intermediate value between both is the combustion pattern Gr.12', it is possible to approximately group the combustion patterns from the magnitude of m. However, as shown, it can be seen that the variations are large.

(Method of Estimating Mass Burn Fraction 50% Timing)

As mentioned above, according to Expression (2), IMEP is obtained from the amplitudes $b_1$ and $b_2$ of the frequency components of one or two times, using the rotational frequency of the crankshaft included in the cylinder pressure waveform as the fundamental frequency. Additionally, it is confirmed that an excellent correlation is established between the amplitudes $b_2$ to $b_5$ of the higher harmonic waves, and the MBF timing ($\theta_{MBF}0.3$, $\theta_{MBF}0.5$, and $\theta_{MBF}0.7$) by deriving even the amplitudes $b_3$ to $b_5$ of the third to fifth higher harmonic waves in addition to these frequency components as described as the case at the start time.

Hereinafter, the same study will be tried with reference to FIGS. 24 and 25.

Figure 24:
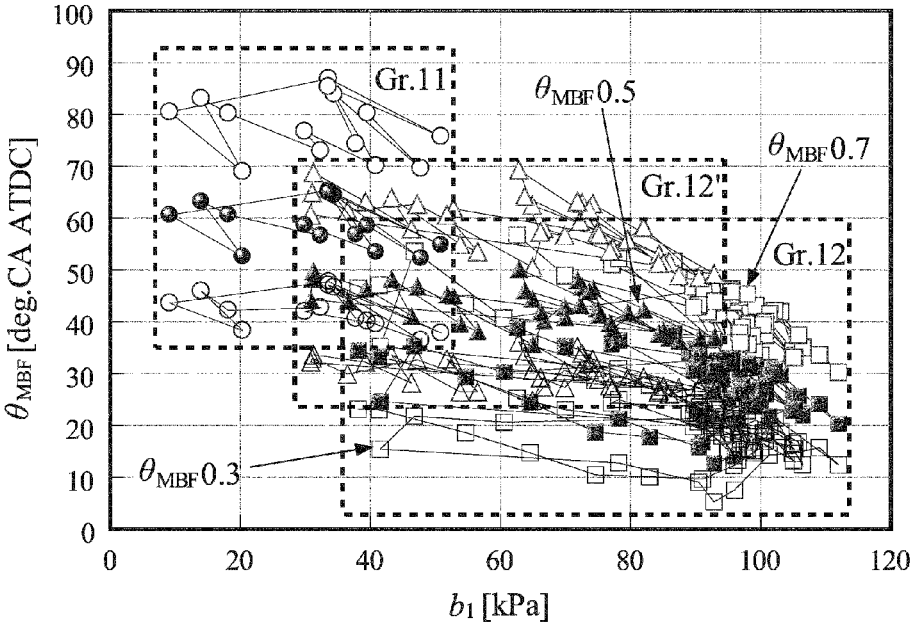
FIG. 24 is a view showing the relationship between the amplitude of a fundamental wave and MBF timing $\theta_{MBF}$ during the acceleration/deceleration operation.

FIG. 24 is a view showing the relationship between the fundamental wave amplitude $b_1$ (horizontal axis) of the first item of the right-hand side of the IMEP operational expression (the aforementioned Expression (2)), and the MBF timing $\theta_{MBF}$ (vertical axis). Additionally, FIG. 25 is a view showing the relationship between the fundamental wave amplitude $b_2$ (horizontal axis) of the second item of the right-hand side of the IMEP operational expression (the aforementioned Expression (2)), and the MBF timing $\theta_{MBF}$ (vertical axis).

The value of $b_1$ shown in FIG. 24 becomes large in the combustion pattern Gr.12 in which the peak value of the heat release rate HR is high, and becomes small in Gr.11 in which the peak value is low. Although there is a tendency as a whole in which the MBF timing $\theta_{MBF}$ declines with respect to an increase in $b_1$, variation is large similar to the case at the start time.

Figure 25:
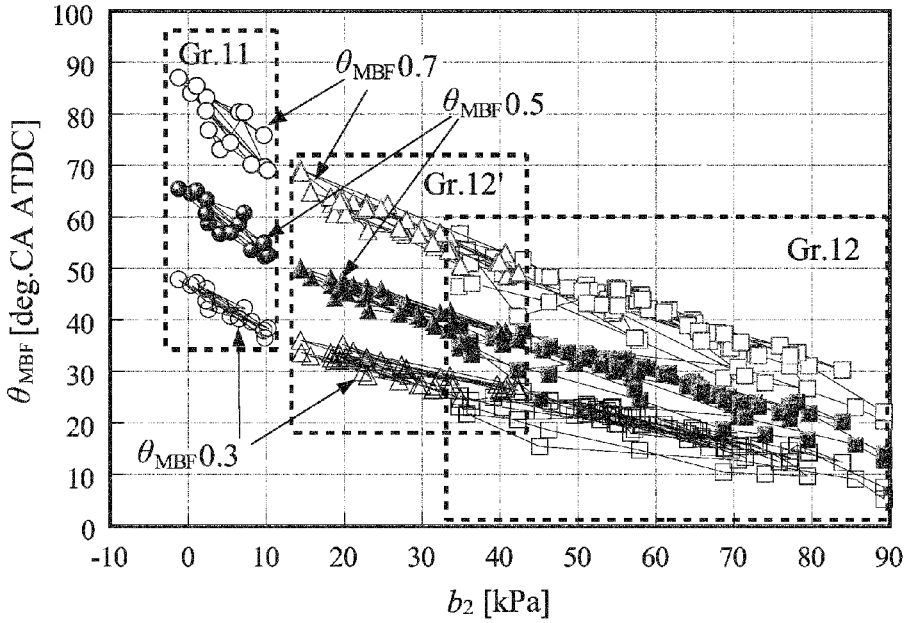
FIG. 25 is a view showing the relationship between the amplitude of a secondary harmonic wave and the MBF timing $\theta_{MBF}$ during the acceleration/deceleration operation.

Meanwhile, the degree of the correlation between $b_2$ and the MBF timing $\theta_{MBF}$, which is shown in FIG. 25, is excellent, and the possibility of estimation of the MBF timing $\theta_{MBF}$ can be confirmed from the magnitude of $b_2$. Additionally, the classification of the combustion patterns is also allowed on the basis of the magnitude of $b_2$.

For example, two threshold values (10 kPa and 34 kPa) that determine the magnitude of $b_2$ are determined, and the groups of the combustion patterns are determined on the basis of the magnitude of $b_2$. According to this determination result, a case where $b_2$ is equal to or less than about 10 kPa is the combustion pattern Gr.11, a case where $b_2$ is equal to or more than about 34 kPa is the combustion pattern Gr.12, and a case where $b_2$ is an intermediate value between both is the combustion pattern Gr.12'.

Next, the analysis results regarding the amplitudes of the third to fifth harmonic waves will be described.

Figure 26:
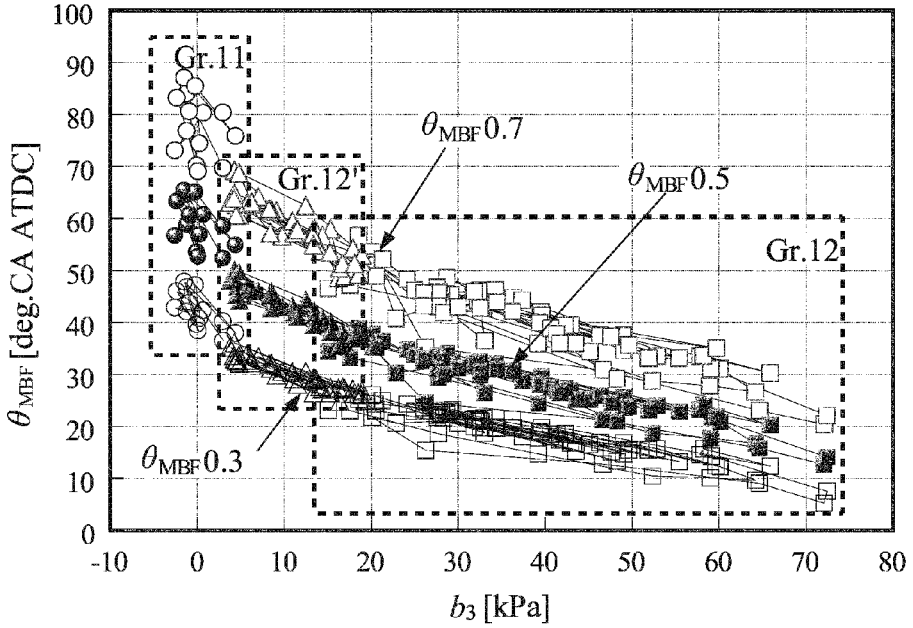
FIG. 26 is a view showing the relationship between the amplitude of a third harmonic wave and the MBF timing $\theta_{MBF}$ during the acceleration/deceleration operation.
Figure 27:
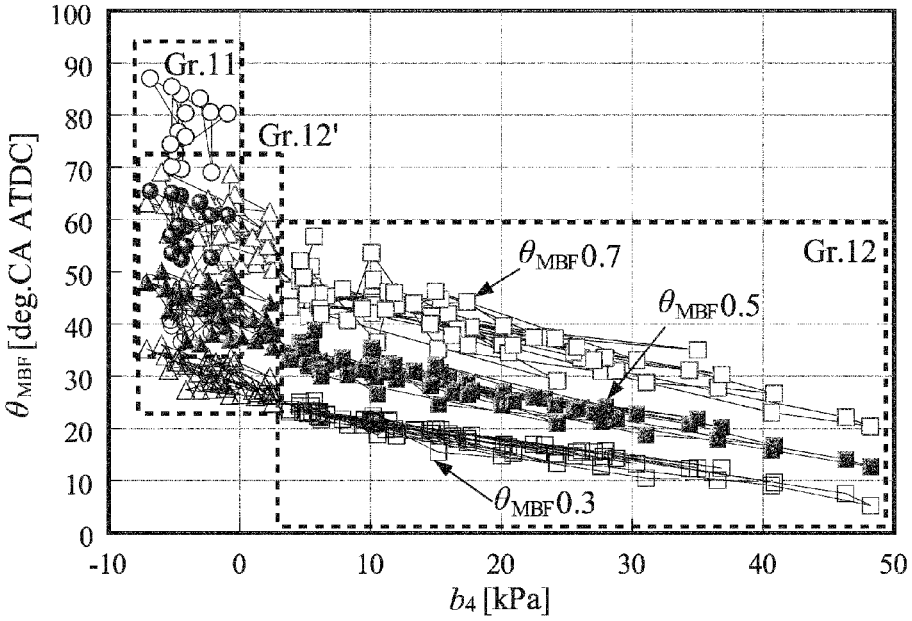
FIG. 27 is a view showing the relationship between the amplitude of a fourth harmonic wave and the MBF timing $\theta_{MBF}$ during the acceleration/deceleration operation.
Figure 28:
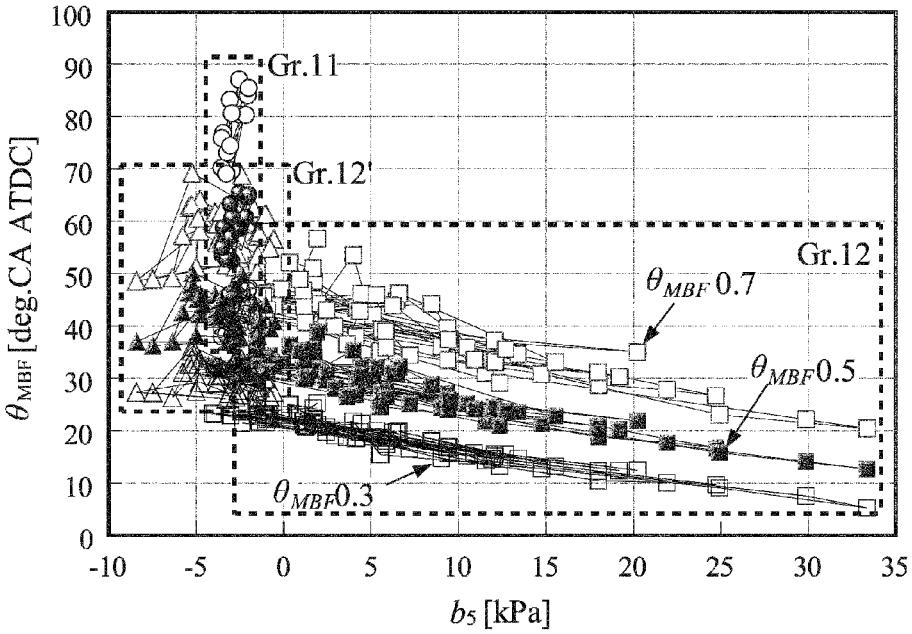
FIG. 28 is a view showing the relationship between the amplitude of a fifth harmonic wave and the MBF timing $\theta_{MBF}$ during the acceleration/deceleration operation.

FIGS. 26 to 28 are views showing the analysis results regarding the amplitudes of the third to fifth harmonic waves, respectively.

The same study results regarding the amplitudes $b_3$ to $b_5$ of the third to fifth harmonic waves are shown in FIGS. 26 to 28. A tendency in which the combustion patterns Gr.11 Gr.12' overlap each other with an increase in the harmonic wave order, and the portion of the combustion pattern Gr.12 extends laterally is the same as that of the case at the start time.

If estimation of the MBF50% timing $\theta_{MBF}0.5$ is allowed using the aforementioned relationship from the amplitudes $b_2$ to $b_5$ of the secondary to fifth harmonic waves, the combustion analysis at calculation intervals of about 1 deg. CA becomes unnecessary according to the aforementioned Expressions (4) and (5). Additionally, if $b_2$ can be used as the second item of the right-hand side of the IMEP operational expression (2) as an index, there is no need for a new operation, and thus, it is convenient for a user.

To confirm this possibility, a correlation coefficient and slope are obtained regarding a case of Gr.11+Gr.12+Gr.12' including all the combustion patterns and a case of Gr.12+Gr.12' excluding the combustion pattern Gr.11 from these combustion patters, from the relationships between the amplitude components $b_1$ to $b_5$ of the fundamental wave to fifth harmonic wave and the MBF timings $\theta_{MBF}0.3$, $\theta_{MBF}0.5$ and $\theta_{MBF}0.7$, which are shown in FIGS. 24 to 28.

Figure 29:
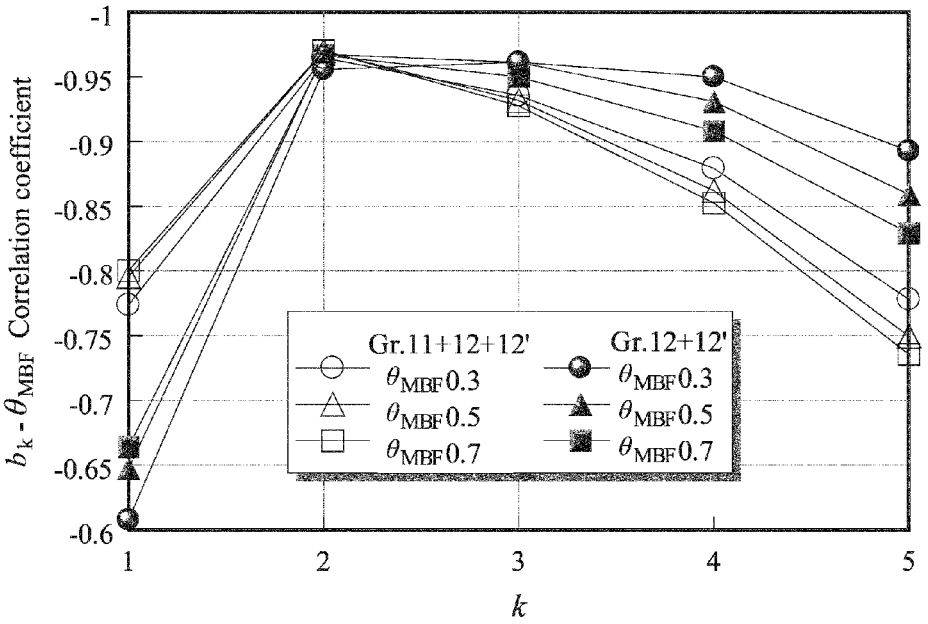
FIG. 29 is a view showing the correlation between a harmonic wave order k and the MBF timing during the acceleration/deceleration operation.

FIG. 29 is a view showing the correlation between the harmonic wave order k during the acceleration/deceleration operation and the MBF timing $\theta_{MBF}$.

Figure 30:
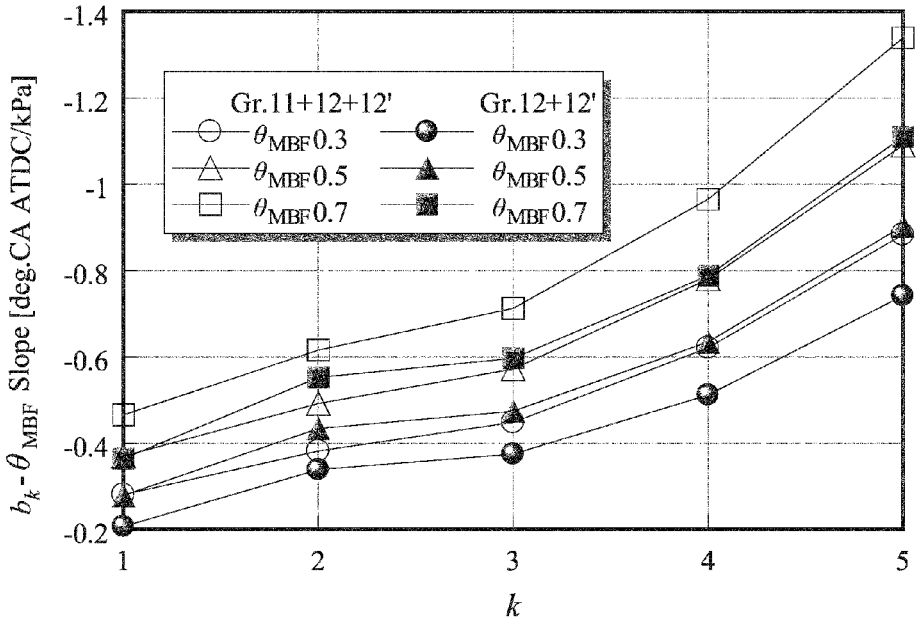
FIG. 30 is a view showing the slope of the MBF timing $\theta_{MBF}$ to the amplitudes of frequency components during the acceleration/deceleration operation.

Additionally, FIG. 30 is a view showing the slope of the MBF timing $\theta_{MBF}$ to the amplitudes of the frequency components during the acceleration/deceleration operation.

From FIG. 29, as for both of the combustion patterns Gr.11+Gr.12+Gr.12', and Gr.12+Gr.12', the correlation between $b_2$ and the MBF timings $\theta_{MBF}0.3$, $\theta_{MBF}0.5$ and $\theta_{MBF}0.7$ is the strongest compared to the other higher order, and the correlation coefficient is within a range of negative values −0.96 to −0.97. In $b_3$ to $b_5$ having higher order than said order, there is a tendency in which the correlation becomes weak with an increase in the order.

However, in the case of Gr.12+Gr.12', the correlation coefficient becomes about −0.9 even in $b_3$ and $b_4$. Moreover, in the case of Gr.12+Gr.12', the correlation with $\theta_{MBF}0.7$ is lower compared to the others.

Meanwhile, FIG. 30 shows the slope of the correlation. Since sensitivity becomes higher as the slope is gentler when the MBF timing $\theta_{MBF}0.5$ is estimated from the magnitude of $b_k$, it is desirable that the absolute value of the slope be smaller. It can be confirmed from FIG. 30 that the slopes in $b_2$ and $b_3$ are the approximately same value, and if the order becomes larger than this value, the slope becomes steep.

Figure 31:
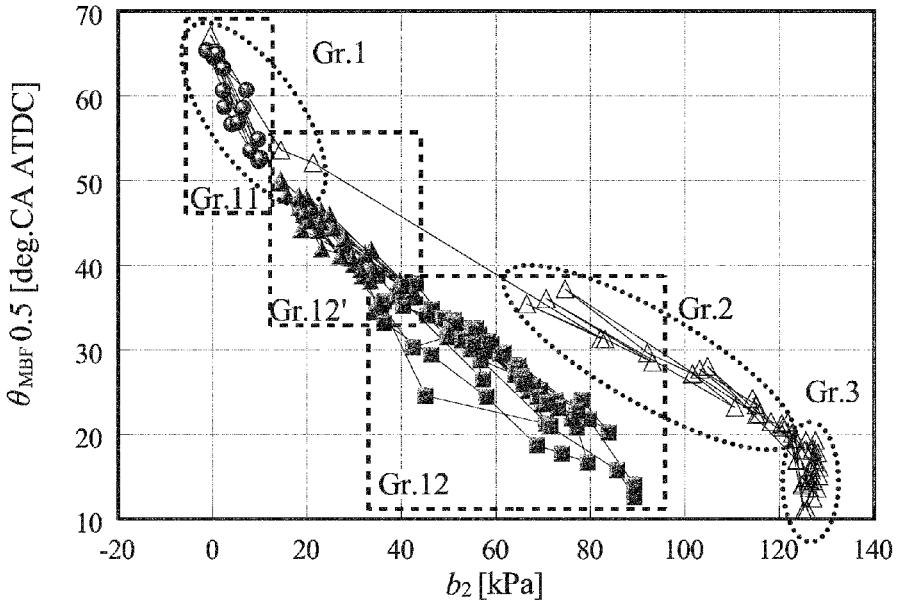
FIG. 31 is a view showing the relationship between the amplitude $b_2$ of the secondary harmonic wave and MBF timing $\theta_{MBF}$ 0.5 at the time of the acceleration/deceleration operation and the start.

The relationship between the amplitude $b_2$ of the secondary harmonic wave and the MBF timing $\theta_{MBF}0.5$ at the time of the acceleration/deceleration operation and the start will be described with reference to FIG. 31. FIG. 31 is a view showing the relationship between the amplitude $b_2$ of the secondary harmonic wave and the MBF timing $\theta_{MBF}0.5$ at the time of the acceleration/deceleration operation and the start. In FIG. 31, the results (Gr.11, Gr.12, and Gr.12') at the time of the acceleration/deceleration operation and the results (Gr.1, Gr.2, and Gr.3) at the start time are plotted on the same graph.

Both data are detected in different engines, and two graphs do not overlap each other, but can be approximated to straight lines or curved lines according to respective slopes. In addition, the combustion pattern Gr.3 having two peaks in the heat release rate is not observed at the time of the acceleration/deceleration operation.

However, the variation width of $b_2$ to a pressure change in $P_{max}$ shows an approximately equal value in both engines in the combustion pattern Gr.11 showing the same level of cylinder pressure as the motoring pressure.

Moreover, as the combustion patterns showing one heat release rate peak, the combustion patterns Gr.12 and Gr.12' at the time of the deceleration operation and the combustion patterns Gr.2 at the start time are the results obtained from the different engines. However, in both of the combustion patterns Gr.12 and Gr.12' at the time of the deceleration operation, and the combustion pattern Gr.2 at the start time, $\theta_{MBF}0.5$ decreases linearly with respect to an increase in $b_2$, and the tendency thereof becomes the same.

In this way, although the relationships between $b_2$ to $b_5$ and the MBF timing $\theta_{MBF}0.5$ are inherent in the respective engines, the points that these relationships can be used as an index when the combustion patterns are classified and can be used as an index when the MBF timing $\theta_{MBF}0.5$ is estimated are common.

Application to control of engines of actual vehicles is allowed by using the amplitudes of harmonic waves up to about secondary to fifth order as the indexes for the classification of the combustion patterns and the estimation of the MBF timing $\theta_{MBF}0.5$.

This is because, in the case of an engine that is operated at a a rotation speed NE of 6000 rpm, the secondary to fifth harmonic waves become low-frequency components in a range of 200 to 500 Hz. As a result, the desired value of the natural frequency of the sensor unit 16 can be set to be low with respect to a cylinder pressure sensor that directly measures the cylinder pressure.

Moreover, the number of data items, such as the cylinder pressure, to be used can be reduced in the specific calculation of $b_2$ to $b_5$ according to Expression (3). This contributes also to reduction of ECU operation load.

Figure 32:
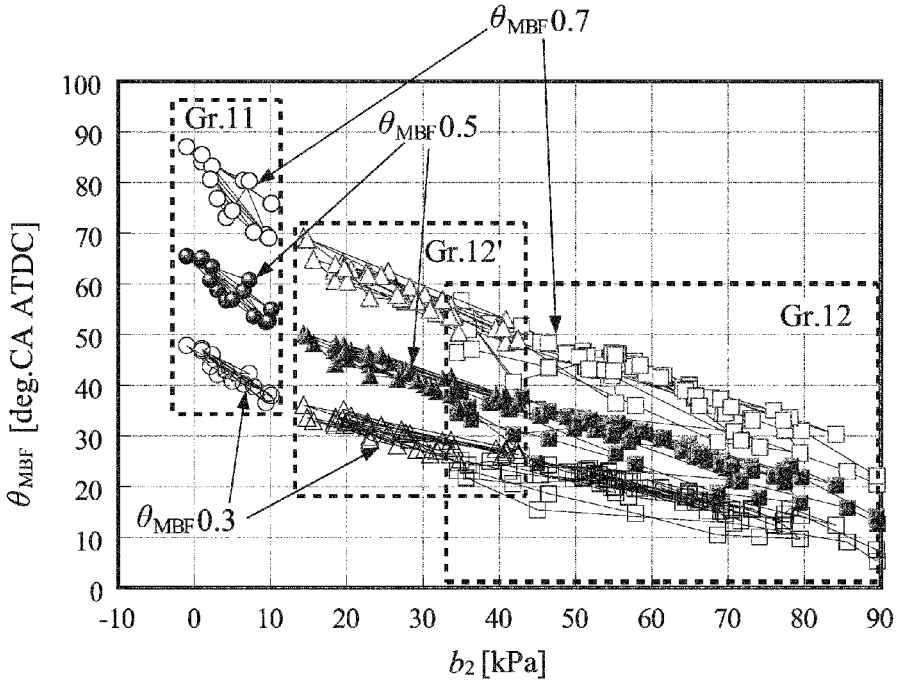
FIG. 32 is a view showing a case where the number of data items, such as the cylinder pressure, is reduced, in the calculation of $b_2$ during the acceleration/deceleration operation.

FIG. 32 is a view showing a case where the number n of data items, such as the cylinder pressure, to be used is reduced in the calculation of $b_2$ according to Expression (3). FIG. 32 shows the results when the number of data items is reduced to n=72 of intervals of 10 deg. CA. When a calculation method up to now, that is, the method of performs operation according to Expressions (4) and (5), is used, as the data of the cylinder pressure, n=720 is required as the number of data items of intervals 1 deg. CA. As shown in FIG. 32, the results when the number of data items is reduced to n=72 of intervals of 10 deg. CA are shown. FIG. 32 approximately coincides with the results of the aforementioned FIG. 25 obtained by calculating $b_2$ with the number of data items of the intervals of 1 deg. CA being n=720. Additionally, as for both of the combustion patterns Gr.11+Gr.12+Gr.12', and Gr.12+Gr.12', the correlation coefficient between $b_2$ and the MBF timings $\theta_{MBF}0.3$, $\theta_{MBF}0.5$ and $\theta_{MBF}0.7$ is within a range of negative values −0.96 to −0.97 and this correlation coefficient also becomes the approximately same value.

To summarize the above, the following results can be obtained.

(1) The approximate accuracy of MBF according to the Wiebe function with respect to the combustion patterns Gr.11, Gr.12, and Gr.12', which appear at time of the acceleration/deceleration operation, is excellent.

(2) A proportional relationship is established between the amplitudes $b_2$ to $b_5$ of the secondary to fifth harmonic waves included in the cylinder pressure waveform, and the MBF timings $\theta_{MBF}0.3$, $\theta_{MBF}0.5$, and $\theta_{MBF}0.7$. It is believed from this that $b_2$ to $b_5$ are used as the indexes for the estimation of the MBF timings and the classifications of the combustion patterns. In the case of $b_2$, the correlation coefficient becomes −0.96 to −0.97, and shows strong correlation. This value becomes approximately the same even if the number of cylinder pressure data items during one cycle is reduced to n=72 of intervals of 10 deg. CA.

(3) Although the relationship between $b_2$ to $b_5$, and the MBF timing $\theta_{MBF}$ becomes inherent in engines with different specifications from the comparison between the results in the engines, the fact that both are proportional is the same, and it is confirmed that the possibility of the classification of the combustion patterns $b_2$ to $b_5$ and the estimation of the MBF timing $\theta_{MBF}$ is common. According to this technique, the combustion analysis of HR or the like becomes unnecessary.

As shown above, the principle of calculating the MBF timing $\theta_{MBF}$ without performed the combustion analysis has been described.

(Method of Estimating MBF Timing when S/N Ratio of Output Signal of Sensor is Poor)

A method of estimating the MBF timing in a case where the S/N ratio of an output signal of a sensor is poor will be described with reference to FIG. 33. Here, the case where the S/N ratio of the output signal of the sensor is poor means a case where a signal to noise ratio (S/N ratio) becomes low when a component showing a change in the cylinder pressure included in an output signal of a sensor is defined as a signal component (S component) and fluctuation components other than the component showing the change in cylinder pressure are defined as a noise component (N component).

Figure 33:
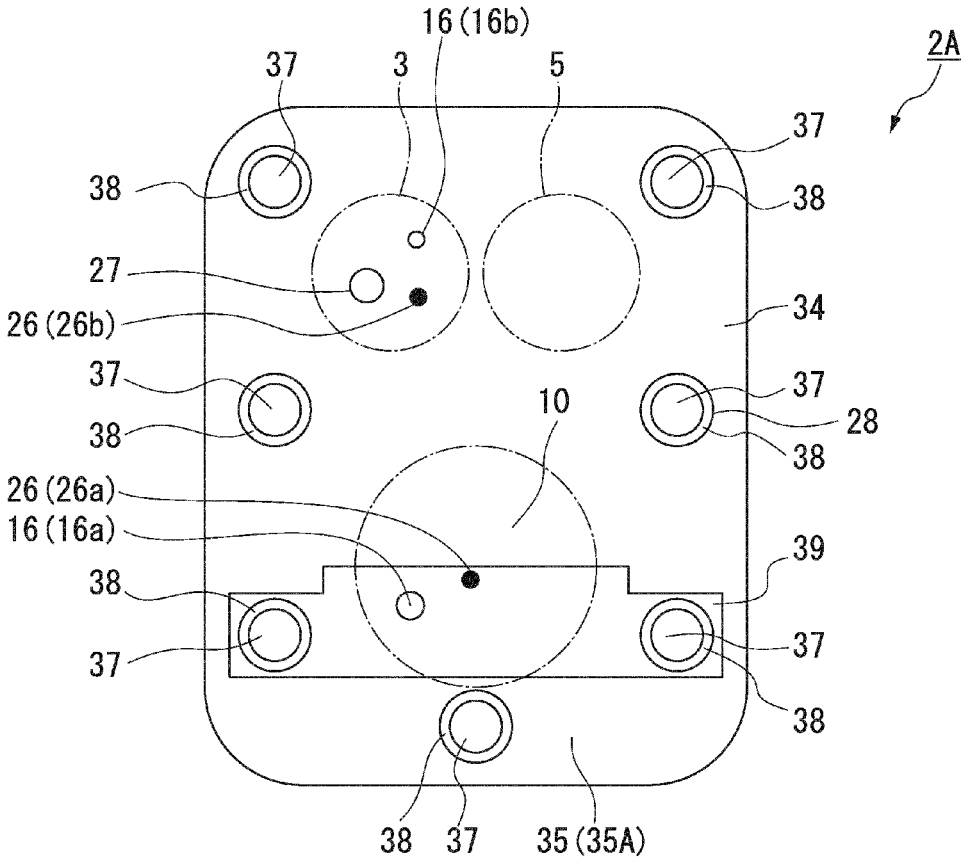
FIG. 33 is a schematic view showing the positions of the sensors in the cylinder structure in the present embodiment.

FIG. 33 is a schematic view showing the positions of the sensors in the cylinder structure in the present embodiment. In FIG. 33, similar to the aforementioned FIG. 3, the positions of the respective sensors in the cylinder structure 2A are shown in a plan view as viewed from a cylinder head 35 (35A) side with respect to the cylinder structure 2A. The same components as those of the aforementioned FIG. 3 among the components shown in FIG. 33 will be designated by the same reference numerals.

The respective sensors can be simultaneously provided at a cylinder head 35A in FIG. 33. Here, the results measured by sensors attached to different positions in the cylinder head 35A, different types of sensors, or the like are compared.

For example, reference numeral 16*b* designates a gap sensor, reference numerals 26*a* and 26*b* designates acceleration sensors, reference numeral 27 designates a pressure sensor that measures the cylinder pressure, and reference numeral 28 designates a load washer. The respective sensors are provided in places that are easily influenced by the vibration when the internal combustion engine 2A drives. Therefore, particularly the acceleration sensors 26 (26*a*, 26*b*) are easily influenced by noise or disturbance. Additionally, an output signal of the pressure sensor 27 that directly measures cylinder pressure has a problem of the zero drift that the offset value of a signal component (S component) changes. In this way, even if any sensors are used, the sensors are influenced by noise, disturbance, or the like. Therefore, even when the S/N ratio of the output signal of a sensor is poor, it is desired that the MBF timing $\theta_{MBF}$ can be calculated. Therefore, it is shown that the MBF timing $\theta_{MBF}$ can be calculated by a method shown below even when the S/N ratio of the output signal of the sensor is poor.

The S/N ratios of output signals of the acceleration sensors 26*a* and 26*b* are greatly influenced by the attachment positions of the sensors. For example, the S/N ratio of the output signal of the sensor at the attachment position of the acceleration sensor 26*b* becomes poorer than that at the attachment position of the acceleration sensor 26*a* in FIG. 33.

Hereinafter, a procedure of calculating the MBF timing $\theta_{MBF}$ from an output signal of the acceleration sensor 26*b* attached to the position of the acceleration sensor 26*b* in FIG. 33 so that the S/N ratio of the output signal of the sensor becomes intentionally poor will be described. In addition, in FIG. 33, the position of the acceleration sensor 26*b* is the vicinity of the intake valve 3 in the cylinder head 35. However, it goes without saying that the invention can be applied to a case where the acceleration sensor is attached to positions other than the position of the sensor shown in FIG. 33 or to cases where different types of sensors are used. For example, in FIG. 33, the pressure sensor 27 directly measures the cylinder pressure. Therefore, excellent measurement results in which S/N ratio of an output signal of the sensor is high are obtained. Additionally, when the gap sensor is used, the S/N ratio of an output signal of the sensor at the attachment position of the gap sensor 16*a* of FIG. 33 becomes better than that at the attachment position of the gap sensor 16*b* of FIG. 33.

Figure 34:
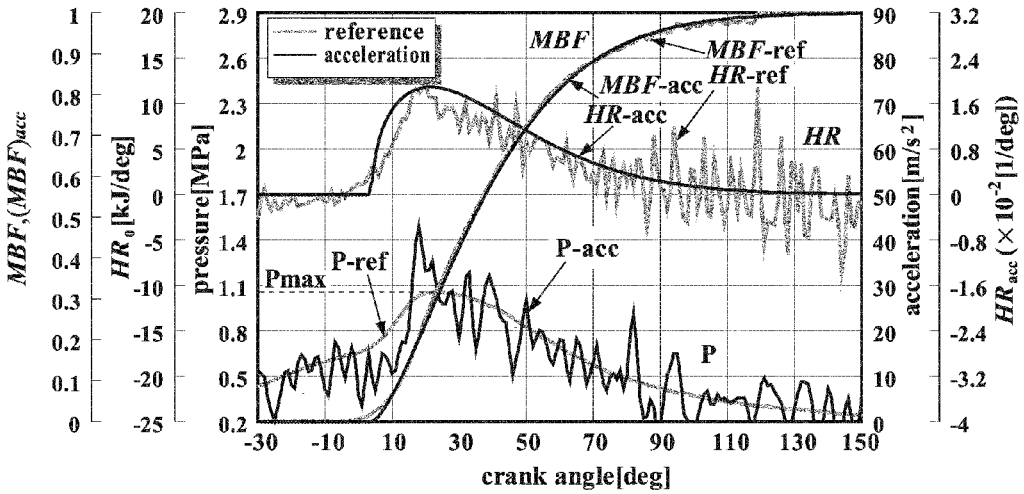
FIG. 34 is a view showing the results the cylinder pressure P, HR, and MBF calculated on the basis of output signals of an acceleration sensor, and the cylinder pressure P, HR, and MBF obtained by a digital compression sensor are overwritten.

FIG. 34 is a view showing an example of combustion parameters indirectly measured from an output signal of the acceleration sensor 26*b* (FIG. 33) and combustion parameters measured by the pressure sensor 27 (FIG. 33) by comparison. Changes in the combustion parameters (vertical axis) from the crank angle (horizontal axis) are shown in FIG. 34. In the vertical axis of FIG. 34, the cylinder pressure P, HR, and MBF are shown as the combustion parameters. Additionally, by showing the combustion parameters with any suffixes of "_ref" and "_acc" being attached to the combustion parameters, respectively, the results measured by the pressure sensor 27 (FIG. 33) are shown as "ref", and the results indirectly measured from output signals of the acceleration sensor 26*b* (FIG. 33) are shown as "acc".

In the cylinder pressure P shown in FIG. 34, a peak of a cylinder pressure (p_acc) indirectly measured from an output signal of the acceleration sensor 26*b* is observed near a maximum cylinder pressure $P_{max}$ of a cylinder pressure (p_ref) measured by the pressure sensor 27. Additionally, it can be understood that a change in the cylinder pressure (p_acc) indirectly measured from the output signal of the acceleration sensor 26*b* resembles a change in the cylinder pressure (p_ref) measured by the pressure sensor 27, in terms of overall tendency, but the level of noise or disturbance superimposed on the signal is quite large with respect to a main signal component.

Therefore, by applying the aforementioned Expression (2) using the amplitude of a low-pass frequency component regarding IMEP, an excellent result in which a correlation coefficient ρ is (ρ>0.98) is obtained. On the other hand, a large error is caused if the maximum cylinder pressure $P_{max}$, and the crank angle $\theta_{pmax}$ at which the maximum cylinder pressure $P_{max}$ is obtained are directly obtained from the same output waveform.

Figure 35:
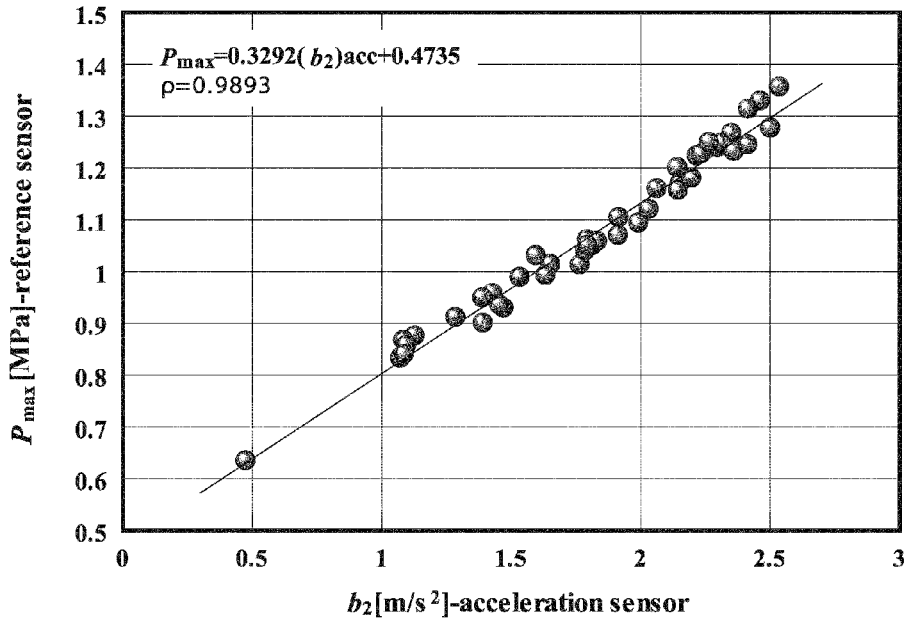
FIG. 35 is a view showing the relationship between the amplitude $b_2$ of the secondary harmonic wave and a maximum cylinder pressure $P_{max}$.

Therefore, monitoring of $P_{max}$ and $\theta_{pmax}$ is performed according to the amplitude $b_2$ of the secondary harmonic wave of the second item of the right-hand side in Expression (2), and the phase $\phi_2$ thereof FIG. 35 is a view showing the relationship between the amplitude $b_2$ of the secondary harmonic wave and the maximum cylinder pressure $P_{max}$. The result is illustrated in FIG. 35 that a proportional relationship is present between the amplitude $b_2$ of a harmonic wave in an output waveform of the acceleration sensor, and $P_{max}$ by the output of the pressure sensor, and the correlation coefficient ρ becomes (ρ>0.98).

Additionally, when the relationship of $\theta_{pma}$, with the phase $\phi_2$ of the secondary harmonic wave is investigated, variation is present, but the correlation coefficient ρ thereof is (ρ=−0.756), and a proportional relationship can be confirmed. In this way, by using the amplitude and phase of the harmonic wave included in the output waveform of the acceleration sensor, it is possible to perform monitoring with higher accuracy than directly obtaining $P_{max}$ and $\theta_{pmax}$ from the output signal of the acceleration sensor shown in FIG. 34.

Meanwhile, in the combustion analysis, it is necessary to perform differential operation in addition to signal processing, such as atmospheric pressure location and pressure conversion. When a large disturbance or noise is overlapped on a signal waveform, the analysis becomes more difficult.

Thus, MBF can be estimated by function-approximating the relationship between the amplitude $b_k$ of the higher harmonic waves included in the output waveform of the acceleration sensor, and the MBF timing $\theta_{MBF}$ and by reversely operating the parameters of the Wiebe function of Expression (6) on the basis of this function-approximation.

As described earlier, since a=6.908 is obtained by regarding the timing at which $MBF_W$=0.999 as the combustion end timing (x=1) in Expression (6), the three remaining unknowns m, $\theta_s$, and $\theta_e$ are calculated from the relationship between three arbitrary MBF and crank angles ($MBF_1$, $\theta_{MBF1}$), ($MBF_2$, $\theta_{MBF2}$), and ($MBF_3$, $\theta_{MBF3}$). The aforementioned three arbitrary MBF and crank angles are estimated from the amplitude $b_k$ (k is order) of the higher harmonic waves included in the waveform of the acceleration sensor.

Although the aforementioned three arbitrary MBF and crank angles ($MBF_1$, $\theta_{MBF1}$), ($MBF_2$, $\theta_{MBF2}$), and ($MBF_3$, $\theta_{MBF3}$) are not particularly limited, for example, MBF timings $\theta_{MBF}$ at which MBF becomes 0.05, 0.25, and 0.80, respectively, are preferable.

Figure 36:
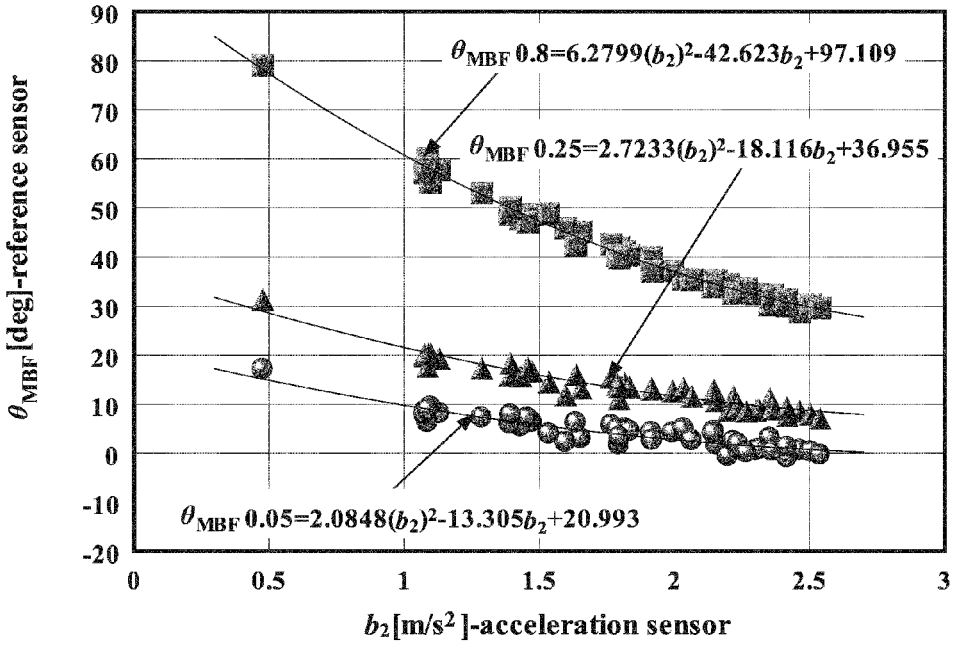
FIG. 36 is a view showing the relationship between the amplitude $b_2$ of the secondary harmonic wave included in the output waveform of the acceleration sensor, and $\theta_{MBF0.05}$, $\theta_{MBF0.25}$, and $\theta_{MBF0.80}$ obtained by the output of the digital compression sensor.

The relationship between the amplitude $b_2$ of the secondary harmonic wave included in the output waveform of the acceleration sensor, and $\theta_{MBF0.05}$, $\theta_{MBF0.25}$, and $\theta_{MBF0.80}$ obtained by the output of the pressure sensor will be described with reference to FIG. 36. FIG. 36 is a view showing the relationship between the amplitude $b_2$ of the secondary harmonic wave included in the output waveform of the acceleration sensor, and $\theta_{MBF0.05}$, $\theta_{MBF0.25}$, and $\theta_{MBF0.80}$ obtained by the output of the pressure sensor. The graph shown in FIG. 36 is given by simultaneously performing the results of the cylinder pressure measured in advance by the pressure sensor 27, and the detection of the cylinder pressure calculated from an output signal of an external sensor (here, the acceleration sensor 26*b*), and obtaining a relational expression $\theta_{MBF}=f(b_2)$ between $\theta_{MBF}$ obtained by the pressure sensor 27 and the amplitude $b_2$ of the secondary harmonic wave in the waveform of the external sensor.

Although the order of the amplitude $b_k$ of the higher harmonic waves included in the output signal of the acceleration sensor 26*b* is not particularly limited, if the order is the second order (k=2), a correlation becomes relatively excellent in broad operating conditions, and $b_2$ may be obtained in an IMEP calculation process. When $b_2$ is obtained in the IMEP calculation process in this way, it is preferable to share the operation result of $b_2$, thereby making individual calculation of $b_2$ unnecessary.

Here, if the relationship between $b_2$ and $\theta_{MBF}$ is approximated by a secondary expression, conversion is made as in Expression (7).

[Expression 8]

$$\theta_{MBF0.25}=2.0848(b_2)^2-13.305b_2+20.993$$

$$\theta_{MBF0.25}=2.7233(b_2)^2-18.116b_2+36.955$$

$$\theta_{MBF0.80}=6.2799(b_2)^2-42.623b_2+97.109 \quad (7)$$

According to the approximate expression of the above Expression (7), $\theta_{MBF0.05}$, $\theta_{MBF0.25}$, and $\theta_{MBF0.80}$ are estimated from the value of $b_2$, and the unknowns m, $\theta_s$, and $\theta_e$ of the Wiebe function are calculated from these values. Additionally, the estimation value (MBF_acc) of MBF of the respective MBF timings can be obtained from the approximate expression of MBF shown in the aforementioned Expression (6).

The relationship between MBF and the crank angle θ obtained as mentioned above is shown in the aforementioned FIG. 34. In FIG. 34, (MBF_acc) coincides with (MBF_ret) obtained from the output signal of the pressure sensor 27 well except for the ignition timing. Additionally, it can be understood that a heat release rate equalizing value (HR_acc) calculated by differentiating (MBF_acc) shows the tendency of a change similar to the heat release rate (HR_ref) obtained from the output signal of the pressure sensor 27.

By applying the detecting method of the present embodiment, the measurement of the cylinder pressure by the pressure sensor 27 becomes unnecessary. Additionally, the estimation of MBF, the MBF timing, and the heat release patterns HR is allowed even when the S/N ratio of the output signal of the external sensor is poor and it is difficult to directly perform the combustion analysis.

Additionally, according to the detecting method of the present embodiment, the types of the sensors are not limited to the acceleration sensor, the force sensor, the gap sensor, or the like, and can also be applied to the pressure sensor that directly measures the cylinder pressure. For example, in the output signal of the pressure sensor, even when the zero drift of the output signal of the sensor occurs due to thermal influence, even when pressure conversion is difficult, or the like, detection can be made without being influenced by these. Advantageous effects can be exhibited by the detecting method of the present embodiment.

In this section, the description regarding the method of determining variables $\theta_s$, $\theta_c$, and m in the expression of the Wiebe function shown in the aforementioned Expression (6) will be supplemented.

Expression (6) shown earlier is modified to obtain Expression (8). In addition, a in Expression (8) is a fixed number (for example, a=6.908) as mentioned above.

[Expression 9]

$$\log\left[\frac{-\ln(1-MBF_W)}{a}\right]=(m+1)\log\left(\frac{\theta-\theta_s}{\theta_e-\theta_s}\right) \quad (8)$$

Now, three known points arranged on an MBF pattern (curved line) are determined, and the coordinates thereof are represented by ($MBF_1$, $\theta_{MBF1}$), ($MBF_2$, $\theta_{MBF2}$), and ($MBF_3$, $\theta_{MBF3}$). These are substituted in the aforementioned Expression (8), respectively, and expressions showing in Expression (9) to Expression (11) are obtained, respectively.

[Expression 10]

$$A_1=\log\left[\frac{-\ln(1-MBF_1)}{a}\right]=(m+1)\log\left(\frac{\theta_{MBF1}-\theta_s}{\theta_e-\theta_s}\right) \quad (9)$$

[Expression 11]

$$A_2=\log\left[\frac{-\ln(1-MBF_2)}{a}\right]=(m+1)\log\left(\frac{\theta_{MBF2}-\theta_s}{\theta_e-\theta_s}\right) \quad (10)$$

[Expression 12]

$$A_3=\log\left[\frac{-\ln(1-MBF_3)}{a}\right]=(m+1)\log\left(\frac{\theta_{MBF3}-\theta_s}{\theta_e-\theta_s}\right) \quad (11)$$

Additionally, the relationships shown in Expression (9) to Expression (11) are arranged to obtain Expression (12).

[Expression 13]

$$Z=\frac{A_1-A_2}{A_2-A_3}=\frac{\log\left(\frac{\theta_{MBF1}-\theta_s}{\theta_{MBF2}-\theta_s}\right)}{\log\left(\frac{\theta_{MBF2}-\theta_s}{\theta_{MBF3}-\theta_s}\right)}=\frac{\log\left(\frac{\theta_{MBF1}-\theta_s}{\theta_{MBF2}-\theta_s}\right)}{\log\left(\frac{\theta_{MBF2}-\theta_s}{\theta_{MBF3}-\theta_s}\right)} \quad (12)$$

Moreover, the following Expression (13) is derived by modifying Expression (12).

[Expression 14]

$$\left(\frac{\theta_{MBF2}-\theta_s}{\theta_{MBF3}-\theta_s}\right)^Z=\left(\frac{\theta_{MBF1}-\theta_s}{\theta_{MBF2}-\theta_s}\right) \quad (13)$$

Since the unknown in Expression (13) is only $\theta_s$, $\theta_s$ can be obtained by solving this expression.

Meanwhile, as for $\theta_c$ and m, $\theta_c$ and m can be obtained according to Expression (14) by solving Expression (9) and Expression (10).

[Expression 15]

$$\theta_e=\theta_s+10^d \quad (14)$$

In addition, d in Expression (14) is shown in Expression (15).

[Expression 16]

$$d=\frac{A_1\log(\theta_{MBF2}-\theta_2)-A_2\log(\theta_{MBF1}-\theta_s)}{A_1-A_2} \quad (15)$$

Additionally, as shown in Expression (16), m can be obtained according to Expression (9).

[Expression 17]

$$m=A_1\Big/\log\left(\frac{\theta_{MBF1}-\theta_s}{\theta_e-\theta_s}\right)-1 \quad (16)$$

In this way, $\theta_e$ and m can be uniquely calculated if $\theta_s$ is determined. Hence, a method of calculating $\theta_s$ becomes important. In the following description, study is added to this point.

As is clear from Expression (13) shown earlier, whether this expression becomes a linear equation or a nonlinear equation is determined depending on the value of an exponent Z. For example, in the case of Z=1, this expression becomes a linear equation, and $\theta_s$ is required from a simple algebraic equation. In contrast, in the case of Z≠1, Expression (13) becomes a nonlinear equation. Even if Expression (13) is a nonlinear equation, in Z=2, that is, a case where Expression (13) is arranged and becomes a secondary equation regarding $\theta_s$ and in Z=3, that is, a case where Expression (13) is arranged and becomes a third equation regarding $\theta_s$, a solution can be obtained by applying a quadratic formula or a cubic formula. Additionally, in the case of Z=0.5, as will be described below, the expression is arranged and become a secondary equation regarding $\theta_s$. Thus, a solution can be obtained by applying a quadratic formula similarly. In this way, in Expression (13), it is difficult to obtain $\theta_s$ except for special cases, such as Z=2, Z=0.5, or Z=3. Since it is difficult to obtain a solution in cases other than Z=2, Z=0.5, or Z=3, for example, it is necessary to apply the Newton Raphson method or the like, and perform at least several repeated calculations to calculate $\theta_s$ numerically. Execution of this operation in real time on board causes an increase in the operation load in ECU.

Also to improve the response of control, it is desirable to make the operation load of ECU as light as possible in the calculation of $\theta_s$. For this purpose, it is necessary to determine three points where the values of $A_1$, $A_2$, and $A_3$ of Expression (9) to Expression (11) that determine the value of Z is calculated, that is, in three points ($MBF_1$, $\theta_{MBF1}$), ($MBF_2$, $\theta_{MBF2}$), and ($MBF_3$, $\theta_{MBF3}$) that are shown as known points so that the conditions of Z=1, 2, 0.5, and 3 to be analytically solved by Expression (13) are satisfied. In the following, calculation expressions of $\theta_s$ when Z takes the above-described values, and the relationships (selecting methods) of the known three points that satisfy the calculation expressions are clarified.

i) In the case of Z=1

In the case of Z=1, Expression (13) becomes a linear equation regarding $\theta_s$, and $\theta_s$ is obtained by the following Expression (17).

[Expression 18]

$$\theta_s = \frac{\theta_{MBF2}^2 - \theta_{MBF1}\theta_{MBF3}}{2\theta_{MBF2} - \theta_{MBF1} - \theta_{MBF3}} \tag{17}$$

Additionally, the relationship of the known three points that satisfy Z=1 becomes the following Expression (18) if the conditions of the known three points that satisfy Z=1 are obtained from Expression (9), Expression (10), and Expression (12).

[Expression 19]

$$MBF_1 = 1 - \exp\left[\frac{\ln^2(1 - MBF_2)}{\ln(1 - MBF_3)}\right], \quad \text{or, } MBF_3 = 1 - \exp\left[\frac{\ln^2(1 - MBF_2)}{\ln(1 - MBF_1)}\right] \tag{18}$$

ii) In the case of Z=2

In the case of Z=2, Expression (13) becomes a secondary equation regarding $\theta_s$ shown in Expression (19).

[Expression 20]

$$A\theta_s^2 - B\theta_s + C = 0 \tag{19}$$

In addition, in Expression (19), A, B, and C are as shown in Expression (20), respectively.

[Expression 21]

$$\left.\begin{aligned} A &= 3\theta_{MBF2} - \theta_{MBF1} - 2\theta_{MBF3} \\ B &= 3\theta_{MBF2}^2 - 2\theta_{MBF1}\theta_{MBF3} - \theta_{MBF3}^2 \\ C &= \theta_{MBF2}^3 - \theta_{MBF1}^2\theta_{MBF3}^2 \end{aligned}\right\} \tag{20}$$

$\theta_s$ can be obtained as Expression (21) by adopting a value near the combustion TDC (θ=0) from the root of the secondary equation of the above-described Expression (19) as $\theta_s$.

[Expression 22]

$$\theta_s = \frac{1}{2A}\left[B - \sqrt{B^2 - 4AC}\right] \tag{21}$$

Additionally, the relationship of the known three points that satisfy Z=2 becomes the following Expression (22) from Expression (9), Expression (10), and Expression (12).

[Expression 23]

$$MBF_1 = 1 - \exp\left[-\frac{\{-\ln(1 - MBF_2)\}^3}{\{-\ln(1 - MBF_3)\}^2}\right] = 1 - \exp\left[\frac{\ln^3(1 - MBF_2)}{\ln^2(1 - MBF_3)}\right] \tag{22}$$

In addition, in the case of Z=2, the combination of MBF=0.06, MBF=0.50, and MBF=0.90 is allowed, and the estimation of an MBF pattern through MBF=0.50 is allowed.

iii) In the case of Z=0.5

In the case of Z=0.5, Expression (13) becomes a secondary equation regarding $\theta_s$ shown in Expression (23), similar to the case of Z=2.

[Expression 24]

$$A\theta_s^2 - B\theta_s + C = 0 \tag{23}$$

In addition, in Expression (23), A, B, and C are as shown in Expression (24), respectively.

[Expression 25]

$$\left.\begin{aligned} A &= 3\theta_{MBF2} - \theta_{MBF1} - 2\theta_{MBF3} \\ B &= 3\theta_{MBF2}^2 - 2\theta_{MBF1}\theta_{MBF3} - \theta_{MBF1}^2 \\ C &= \theta_{MBF2}^3 - \theta_{MBF1}^2\theta_{MBF3} \end{aligned}\right\} \tag{24}$$

Similar to the case of Z=2, $\theta_s$ can be obtained as Expression (25) by adopting a value near the combustion TDC (θ=0) from the root of the secondary equation of the above-described Expression (23) as $\theta_s$.

[Expression 26]

$$\theta_s = \frac{1}{2A}\left[B - \sqrt{B^2 - 4AC}\right] \tag{25}$$

Additionally, if the conditions of the known three points that satisfy Z=0.5 are obtained by Expression (9), Expression (10), and Expression (12), the following Expression (26) is obtained.

[Expression 27]

$$MBF_1 = 1 - \exp\left[-\frac{\{-\ln(1 - MBF_2)\}^{1.5}}{\{-\ln(1 - MBF_3)\}^{0.5}}\right] \tag{26}$$

In addition, in the embodiment shown above, the rotational frequency of the crankshaft is used as the fundamental frequency. However, one cycle (a series of operation until the air-fuel mixture is taken into the combustion chamber and is combusted and a combustion gas is exhausted from the combustion chamber) of the internal combustion engine may be used as the fundamental frequency.

In that case, it is necessary to take into consideration that the crankshaft make two rotations during one cycle in the case of a four-cycle engine (four-stroke engine), and the crankshaft makes one rotation during one cycle in the case of a two-cycle engine (two-stroke engine). Particularly, when one cycle of the internal combustion engine is adopted as the fundamental frequency in the four-cycle engine, it is possible to calculate the MBF timing $\theta_{MBF}$, using secondary to tenth harmonic wave components of the fundamental frequency.

Additionally, the detailed description of the analysis method in the calculation of MBF shown above is based on $b_k$ obtained by expressing the amplitude of the k-th harmonic wave with the total of the product of the cylinder pressure and the sine function as in the above Expression (3). Even in a case based on $a_k$ obtained by expressing the amplitude of the k-th harmonic wave with the total of the product of the cylinder pressure and the cosine function as in the above Expression (3)' instead of the above Expression (3), analysis can be performed similar to the case based on the above $b_k$.

The correlations between MBF as the results analyzed and obtained from the amplitude of the k-th harmonic wave and actual MBF may be different in cases where analysis based on $b_k$ derived from the sine function is performed and analysis based on $a_k$ derived from the cosine function is performed, depending on the characteristics of the internal combustion engine 2, and the kinds, positions, or the like of the sensors.

The correlations between MBF as the results analyzed and obtained from the amplitude of the k-th harmonic wave, and the actual MBF will be described with reference to FIGS. 37 and 38.

Figure 37:
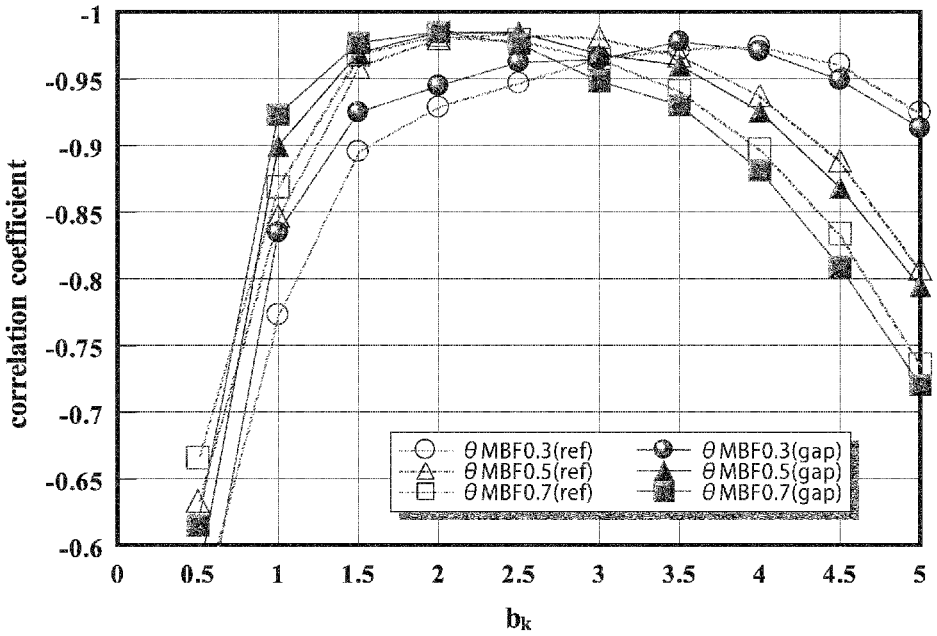
FIG. 37 is a view showing the correlation between MBF obtained on the basis of $b_k$ derived from a sine function, and actual MBF.

FIG. 37 is a view showing the correlation between MBF obtained on the basis of $b_k$ derived from the sine function, and the actual MBF. FIG. 37 shows a change in the correlation coefficient (vertical axis) between MBF obtained on the basis of $b_k$ and the actual MBF, according to the order k of $b_k$ (horizontal axis), on the condition of the combination between the values ($\theta_{MBF0.05}$, $\theta_{MBF0.25}$, and $\theta_{MBF0.80}$) of $\theta_{MBF}$ and the types (the cylinder pressure sensor (ref) and the gap sensor (gap)) of the sensors. According to the correlation coefficient shown in FIG. 37, it can be understood that the value of the correlation coefficient shows (−0.9 to −1) in a range where the value of the order k is from 1.5 to 3.5, and the correlation is high.

Figure 38:
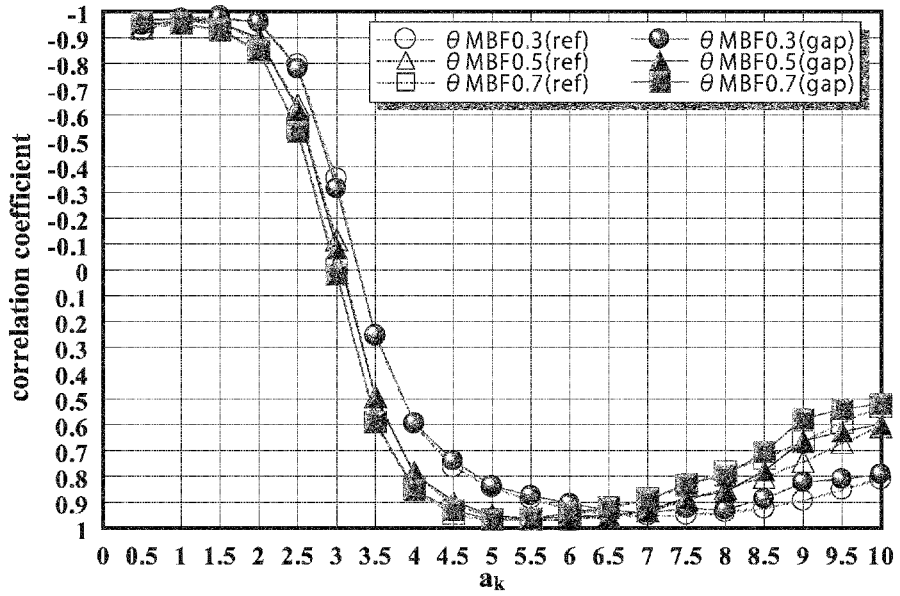
FIG. 38 is a view showing the correlation between MBF obtained on the basis of $a_k$ derived from a cosine function, and the actual MBF.

FIG. 38 is a view showing the correlation between MBF obtained on the basis of $a_k$ derived from the cosine function, and the actual MBF. FIG. 38 shows a change in the correlation coefficient (vertical axis) between MBF obtained on the basis of $a_k$ and the actual MBF, according to the order k of $a_k$ (horizontal axis), on the condition of the combination between the values ($\theta_{MBF0.05}$, $\theta_{MBF0.25}$, and $\theta_{MBF0.80}$) of $\theta_{MBF}$ and the types (the cylinder pressure sensor (ref) and the gap sensor (gap)) of the sensors. According to the correlation coefficient shown in FIG. 38, it can be understood that the value of the correlation coefficient shows (−0.9 to −1) in a range where the value of the order k is from 0.5 to 1.5, and the correlation is high.

In this way, if the case of FIG. 37 is compared with the case of FIG. 38, it can be understood that different tendencies are shown such that the ranges of the orders where the correlation becomes high are different, and particularly regarding FIG. 38, the correlation becomes high even when a frequency lower than the frequency of the fundamental wave is given and the degree k is 0.5.

[Processing in Engine Control Unit]

(Processing Performed by ECU 1 that Detects MBF Timing $\theta_{MBF}$)

Subsequently, the processing performed by the ECU 1 that detects the MBF timing $\theta_{MBF}$ on the basis of the aforementioned principle will be described.

The ECU 1 (detecting device) detects the combustion state of the engine 2 (internal combustion engine) that transmits power via the crankshaft 11.

The CPU 1*b* (calculation unit) in the present embodiment calculates the mass burn fraction MBF by detecting the crank angle, on the basis of the frequency components included in the state change amount of the state change of the cylinder structure 2A (detection target) according to a change in the cylinder pressure depending on the combustion cycle of the engine 2 and including the harmonic wave components of the fundamental wave having the rotational frequency of the crankshaft 11 as the fundamental frequency.

The CPU 1*b* (calculation unit) in the present embodiment calculates the mass burn fraction MBF on the basis of the correlation between the harmonic wave components and the crank angle. The correlation between the harmonic wave components and the crank angle is defined in advance as operational expressions or tables in which information showing relationships are stored, and is stored in the memory 1*c* capable of being referred to by the CPU 1*b* (calculation unit). The CPU 1*b* (calculation unit) calculates the mass burn fraction MBF according to the above operational expressions or the above information stored in the tables.

The CPU 1*b* (calculation unit) in the present embodiment calculates the mass burn fraction MBF from a plurality of frequency components of the frequency components corresponding to frequencies of natural number multiples of the fundamental frequency when the internal combustion engine 2 is a four-cycle engine as mentioned above.

For example, the CPU 1*b* (calculation unit) may include the frequency component (s) up to the fifth order of the fundamental wave as the harmonic wave components, in the frequency components included in the state change amount of the state change. In other words, the CPU 1*b* (calculation unit) may include at least one of the frequency components up to the fifth order of the fundamental wave as the harmonic wave component. For example, the CPU 1*b* (calculation unit) may include at least one of the frequency components of the secondary order, the third order, the fourth order, and the fifth order of the fundamental wave as the harmonic wave component. Additionally, for example, the CPU 1*b* (calculation unit) may include both or any one of fourth and fifth frequency components of the fundamental wave as the harmonic wave components, in the frequency components included in the state change amount of the state change.

In addition, the CPU 1*b* (calculation unit) in the present embodiment can calculate the mass burn fraction MBF from a plurality of frequency components of the frequency components corresponding to frequencies of (natural number −0.5) multiples of the fundamental frequency, thereby performing processing according to the same procedure as in the case of the four-cycle engine, when the internal combustion engine 2 is a two-cycle engine. In short, any frequency group out of a frequency group including frequencies of natural number multiples of the fundamental frequency according to the rotation speed of the crankshaft 11 per one combustion cycle of the internal combustion engine 2 and a frequency group including frequencies of (natural number −0.5) multiples of the fundamental frequency is determined. The CPU 1*b* (calculation unit) can perform the above processing on the basis of a plurality of frequency components among the frequency components corresponding to the frequencies included in the determined frequency group.

Additionally, the CPU 1*b* (calculation unit) in the present embodiment defines an expression showing a combustion model in which the combustion cycle of the internal combustion engine 2 is modeled. The expression showing the combustion model includes, as variables, a first crank angle according to the timing of ignition in the combustion cycle of the internal combustion engine 2, a second crank angle according to the timing of combustion end in the combustion cycle, a third arbitrary crank angle, and a mass burn fraction according to the third crank angle. The CPU 1*b* (calculation unit) calculates the mass burn fraction on the basis of the expression showing the combustion model.

Additionally, in the CPU 1*b* (calculation unit) in the present embodiment, combustion model coefficients showing the combustion model are included in elements of the expression showing the combustion model, and the combustion model coefficients are obtained on the basis of information on a plurality of known sets that are arbitrarily selected among information on sets of crank angles and mass burn fractions according to the crank angles. The CPU 1*b* (calculation unit) calculates the mass burn fraction according to the expression showing the combustion model, which is an operational expression including, as elements, the combustion model coefficients obtained on the basis of the information on the plurality of selected known sets.

Additionally, in the CPU 1*b* (calculation unit) in the present embodiment, to make the operation load of calculating the mass burn fraction light, with respect to the relationship between the respective crank angles ($\theta_{MBF1}$, $\theta_{MBF2}$, and $\theta_{MBF3}$) included in the three known sets and the crank angle $\theta_s$ according to the timing of the ignition, the plurality of known sets are selected so that Z of Expression (13) become any one of 0.5, 1, 2 and 3. The CPU 1*b* (calculation unit) calculates the mass burn fraction according to the expression showing the combustion model, which is obtained on the basis of the information on the plurality of known sets selected in that way.

In this way, the ECU 1 in the present embodiment detects the combustion state of the engine 2 (internal combustion engine) on the basis of the crank angle at which the calculated mass burn fraction MBF is obtained.

(Procedure of Processing of ECU 1 that Detects MBF Timing $\theta_{MBF}$)

Subsequently, the specific procedures of the processing of the ECU 1 that detects the MBF timing $\theta_{MBF}$ on the basis of the aforementioned principle will be described.

(Procedure 1) As shown in the above principle of the present invention, the basic characteristics of the engine 2 as a detection target are detected in advance, and the information according to the basic characteristics is stored in the ECU 1 (memory 1*c*). Information, including the information that determines conversion factors referred to in Procedure 4.5 to be described below, and operation conditions (a selection condition for selecting order, a weighted condition of weighted calculation, or the like) referred to in Procedure 4.5, are included as the information stored in the ECU 1.

(Procedure 2) The sensor unit 16 detects the state change amount of the state change of the cylinder structure 2A (detection target) according to a change in the cylinder pressure depending on the combustion cycle of the engine 2, and sends the state change amount to the ECU 1.

(Procedure 3) The ECU 1 performs input processing (including A/D conversion processing) of the state change amount of the aforementioned state change sent from the sensor unit 16, and stores the result. Procedure 3 is continuously and repeatedly performed on the basis of a predetermined cycle.

(Procedure 4) The ECU 1 calculates the mass burn fraction MBF or the MBF timing $\theta_{MBF}$ on the basis of the state change amount of the state change sent from the sensor unit 16. In addition, the operation processing in Procedure 4 is performed by the CPU 1*b* of the ECU 1. Additionally, Procedure 4 can be subdivided into a plurality of processing items shown below.

(Procedure 4.1) The ECU 1 calculates the rotation speed NE of the crankshaft 11.

(Procedure 4.2) The ECU 1 calculates the rotational frequency of the crankshaft 11 (crankshaft) according to the rotation speed NE.

(Procedure 4.3) The ECU 1 extracts the harmonic wave components of the fundamental wave from the frequency components included in the state change amount of the state change, on the basis of the calculated rotational frequency (fundamental frequency) of the crankshaft 11 (crankshaft) (refer to Expression (3)).

(Procedure 4.4) The ECU 1 calculates the amplitude information (for example, b1 to b5) on the frequency components including the harmonic wave components of the fundamental wave having the rotational frequency of the crankshaft 11 (crankshaft) as the fundamental frequency, from the state change amount of the aforementioned state change stored in the aforementioned Procedure 3.

(Procedure 4.5) The ECU 1 calculates the mass burn fraction MBF on the basis of the amplitude information (for example, b1 to b5) on the frequency components including the harmonic wave components calculated in the aforementioned Procedure 4.4, and the conversion factors stored in the aforementioned Procedure 1.

For example, the ECU 1 subjects the amplitude information on the order selected among the amplitude information (for example, b1 to b5) on the frequency components including the harmonic wave components calculated in the aforementioned Procedure 4.4 to conversion processing according to a linear operational expression or a curvilinear approximate expression determined by conversion factors according to the selected order, thereby calculating the mass burn fraction MBF.

Alternatively, the ECU 1 converts the amplitude information (for example, b1 to b5) on the frequency components including the harmonic wave components calculated in the aforementioned Procedure 4.4, according to a linear operational expression or a curvilinear approximate expression determined by conversion factors according to an order, respectively, and subjects the respective conversion results to the weighted processing, thereby calculating the mass burn fraction MBF.

Additionally, the ECU 1 may calculate the MBF timing $\theta_{MBF}$ from the mass burn fraction MBF calculated according to the above procedures.

(Procedure 5) The EUC 1 outputs the mass burn fraction MBF or the MBF timing $\theta_{MBF}$ calculated in the aforementioned Procedure 4 as a state variable. Additionally, the EUC 1 performs the control required for a controlled target that adjusts the operational state of the engine 2 on the basis of the calculated mass burn fraction MBF or MBF timing $\theta_{MBF}$ as the state variable.

Here, after the processing of Procedure 5 is finished, the EUC 1 repeatedly perform the processing from Procedure 4. In addition, the processing of Procedure 3 is performed in parallel to the processing of Procedure 4 and Procedure 5.

(Control of Engine Based on Mass Burn Fraction MBF)

Subsequently, the control of the engine 2 performed as processing of the above Procedure 5 will be described. The control shown below is shown as an example.

The ECU 1 (CPU1*b*) in the present embodiment controls the internal combustion engine that transmits power via the crankshaft. According to the calculated mass burn fraction, the mass burn fraction according to the detected crank angle (the duration in which the mass burn fraction becomes a predetermined range) or the like according to the detected crank angle, the ECU 1 (CPU 1*b*) can control the operational state of the engine 2. The control of the combustion state of the engine 2 based on the mass burn fraction includes the control of the ignition timing, the control of the fuel injection timing, the control of the exhaust gas recirculation processing, or the like.

(1) In Case of Ignition Timing Control

For example, the ECU 1 may calculate a desired ignition timing on the basis of a crank angle measured by an angle sensor, and the calculated mass burn fraction (refers to the Japanese Unexamined Patent Application, First Publication No. H7-180645).

The above desired ignition timing is calculated by a relational expression of Y=aX+b. Here, Y is ignition timing represented by a crank angle to the top dead center. X is a difference between a crank angle in an arbitrary reference mass burn fraction of fuel injected into a cylinder, and a crank angle in an arbitrary mass burn fraction in a stage in which combustion has proceeded. A and b are fixed numbers determined depending on the characteristics of a spark ignition engine including the ignition plug 9.

(2) In Case of Fuel Injection Timing Control

For example, the ECU 1 calculates a combustion duration θ50-90 equivalent to the duration of 50% to 90% of the mass burn fraction. The combustion duration θ50-90 and a reference value θ (reference) are compared, and it is determined whether or not there is a deviation equal to or greater than a predetermined value between the newest combustion duration θ50-90 (θ (present)) and the reference value θ (reference).

When the deviation equal to or greater than a predetermined value is between the newest combustion duration θ50-90 (θ (present)) and the reference value θ (reference) as the result of the above determination, the ECU 1 corrects the injection timing. When the newest combustion duration θ50-90 is greater than the reference value θ (reference), the ECU 1 repeats advance correction of the injection timing until the combustion duration θ50-90 does not change in a decreasing direction. On the other hand, when the newest combustion duration θ50-90 is equal to or less than the reference value θ (reference), the ECU 1 repeats retard correction of the injection timing until the combustion duration θ50-90 begins to change in an increasing direction (for details, refer to Japanese Unexamined Patent Application, First Publication No. 2000-8928).

(3) When Control of Exhaust Gas Recirculation Processing (EGR Processing) is Performed The EGR 22 returns a portion of exhaust gas to the intake system, and maintains a suitable combustion state.

For example, the ECU 1 can detect the combustion state from the calculated mass burn fraction.

As an example, one or more sensors are used to measure the amount of the exhaust gas that flows in through the EGR 22. For example, since intake air oxygen concentration may be directly related to EGR adjusted with respect to exhaust gas oxygen concentration, the control of the amount of EGR may be performed on the basis of the intake air oxygen concentration or the mass burn fraction.

Additionally, as an example, the EGE 22 may include an exhaust gas sensor, an exhaust gas temperature sensor, an exhaust gas pressure sensor, or the like. In some examples, the sensors that the EGR 22 has may include, for example, one or more sensors to be used to measure the amount of EGR. The amount of EGR, for example, may be controlled on the basis of the mass burn fraction and/or the intake air oxygen concentration.

As described above, the ECU 1 of the present embodiment can detect the crank angle without using a special pressure sensor to thereby easily calculate the mass burn fraction (MBF). Additionally, the ECU 1 of the present embodiment can easily detect the crank angle $\theta_{MBF}$, at which a predetermined mass burn fraction (MBF) is obtained, without measuring the cylinder pressure. Accordingly, an expensive pressure sensor is unnecessary, reliability can also be enhanced, and application to the engine 2 to be mounted on a vehicle becomes easy.

Additionally, the ECU 1 can control the combustion state of the engine 2, on the basis of the detection value (calculation value) of the crank angle $\theta_{MBF}$ at which a predetermined mass burn fraction (MBF) is obtained, and realize low fuel consumption and clean exhaust gas.

Additionally, the ECU 1 can detect the crank angle through the same processing without using a special pressure sensor to thereby easily calculate the mass burn fraction (MBF) while the engine 2 reaches the steady operation from the start thereof or when the acceleration/deceleration operation is performed. Additionally, the ECU 1 of the present embodiment can easily calculate the crank angle $\theta_{MBF}$, at which a predetermined mass burn fraction (MBF) is obtained, similar to the above case.

Additionally, the relationships among the maximum cylinder pressure and its crank angle, the indicated mean effective pressure, the heat release rate, and the mass burn fraction (MBF) are clarified from the experimental results shown in the present embodiment. Accordingly, the ECU 1 can calculate the crank angle $\theta_{MBF}$, at which a predetermined mass burn fraction (MBF) is obtained, through the operation processing of the same method as the calculation method of the indicated mean effective pressure. In short, the ECU 1 can sharing the results of the processing without individually performing different kinds of operation processing, to thereby finish common processing at one time, and this can contribute to a decrease in the amount of operation processing to be performed by the ECU 1.

Additionally, in the present embodiment, the MBF timing $\theta_{MBF}$ is calculated using a glass engine for experiments and a general-purpose four-cycle gasoline engine. However, the invention is not limited to these. For example, the invention can also be applied to a two-cycle gasoline engine, a diesel engine, and a rotary engine.

Additionally, in the present embodiment, the calculation of the MBF timing $\theta_{MBF}$ is described in the case of a mechanism using the crankshaft as a mechanism that converts the reciprocating motion of a piston into a rotational motion of a shaft. However, the invention is not limited to these. The invention can also be applied to other mechanisms that convert the reciprocating motion of the piston into the rotational motion of the shaft, for example, a crosshead mechanism, a scotch yoke mechanism, a Ross-York mechanism, a Rhombic mechanism, a swash plate mechanism, and the like.

Additionally, the above-described ECU 1 may make the programs for realizing the respective functions recorded on computer-readable recording media, and make the programs recorded on this recording media read into and executed in a computer system, to thereby perform the processing of the above-described respective sections, respectively. In addition, the term "computer system" herein includes OS or hardware such as peripheral devices.

Additionally, if the "computer system" uses a WWW system, the computer systems also include a homepage-providing environment (or display environment).

Additionally, the term "computer-readable recording media" mean portable media, such as a flexible disk, a magnetic-optical disk, ROM, and CD-ROM, and storage devices, such as a hard disk, built in the computer system. Moreover, the term "computer-readable recording media" includes recording media that dynamically hold the programs in a short time, like communication lines in cases where the programs are transmitted via networks, such as the Internet, or communication lines, such as a telephone line, or recording media that hold the programs during a certain period of time, like a volatile memory inside the computer system serving as a server or a client in that case. Moreover, the above programs may be programs for realizing some of the aforementioned functions, and may be programs that can realize the aforementioned functions in combination with the programs already recorded on the computer system.

Although the embodiment of the invention was described above in detail with reference to the drawings, the specific configuration is not limited to the embodiment, and design or the like that does not depart from the scope of the invention are also included.

INDUSTRIAL APPLICABILITY

The ECU 1 (detecting device) shown in the present embodiment can detect the crank angle without using a special pressure sensor to thereby easily calculate the mass burn fraction MBF. Accordingly, the ECU 1 (detecting device) can constitute a detecting device that detects the combustion state in the internal combustion engine 2 mounted on, for example, a vehicle or the like.

Additionally, the ECU 1 (detecting device) can control the internal combustion engine 2 according to the information based on the detected results.

Additionally, in movable bodies (for example, a vehicle, a vessel, or the like) including the ECU 1 (detecting device) shown in the present embodiment, and the internal combustion engine 2, the ECU 1 (detecting device) can be appropriately controlled according to the combustion state of the internal combustion engine 2.

What is claimed is:

1. A detecting device that detects a combustion state of an internal combustion engine that transmits power via a crankshaft, the detecting device comprising:

a calculation unit that calculates a mass burn fraction by detecting a crank angle, on the basis of a frequency component showing a state change amount of a state change of a detection target according to a change in a cylinder pressure depending on a combustion cycle of the engine, and including a harmonic wave component of a fundamental wave of the frequency component.

2. The detecting device according to claim 1, wherein the frequency component showing the state change amount of the state change of the detection target is a frequency component including a harmonic wave component of a fundamental wave having a rotational frequency of the crankshaft as a fundamental frequency.

3. The detecting device according to claim 1, wherein the calculation unit calculates the mass burn fraction on the basis of a correlation between the harmonic wave component and the crank angle.

4. The detecting device according to claim 1 wherein the calculation unit calculates the mass burn fraction, using, as the frequency component, a plurality of frequency components among frequency components corresponding to frequencies of natural number multiples of the fundamental frequency or frequencies of (natural number −0.5) multiples of the fundamental frequency.

5. The detecting device according to claim 4, wherein the calculation unit determines any frequency group out of a frequency group including frequencies of natural number multiples of the fundamental frequency according to a rotation speed of the crankshaft per one combustion cycle of the engine or a frequency group including frequencies of (natural number −0.5) multiples of the fundamental frequency, and calculates the mass burn fraction, using, as the frequency component, frequency components corresponding to a plurality of frequencies among frequency components corresponding to the frequencies included in the determined frequency group.

6. The detecting device according to claim 1, wherein the calculation unit includes at least one of the frequency components up to the fifth order of the fundamental wave as the harmonic wave component.

7. The detecting device according to claim 1, wherein the calculation unit includes fourth and fifth frequency components of the fundamental wave as the harmonic wave component.

8. The detecting device according to claim 1, wherein the calculation unit calculates the mass burn fraction on the basis of an expression showing a combustion model obtained by modeling the combustion cycle of the engine, and including, as variables:

a first crank angle according to a timing of ignition in the combustion cycle of the engine, a second crank angle according to a timing of combustion end in the combustion cycle;

a third arbitrary crank angle; and a mass burn fraction according to the third crank angle.

9. The detecting device according to claim 8, wherein a combustion model coefficient inherent in the combustion model is included in an element of the expression showing the combustion model, and the combustion model coefficient is obtained on the basis of information on a plurality of known sets that are arbitrarily selected among information on sets of crank angles and mass burn fractions according to the crank angles, and wherein the calculation unit calculates the mass burn fraction according to the expression showing the combustion model that is an operational expression including the combustion model coefficient in the element.

10. The detecting device according to claim 9, wherein the plurality of known sets that are arbitrarily selected are three sets, wherein a relationship between the respective crank angles of the three sets, and the first crank angle according to the timing of the ignition is represented by Expression (1), and wherein the plurality of known sets are selected so that the relationship between Z of Expression (1) becomes any of 0.5, or 1, 2 and 3

[Expression 1]

$$\left(\frac{\theta_{MBF2}-\theta_s}{\theta_{MBF3}-\theta_s}\right)^Z=\left(\frac{\theta_{MBF1}-\theta_s}{\theta_{MBF2}-\theta_s}\right) \quad (1)$$

$\theta_{MBF1}$, $\theta_{MBF2}$, and $\theta_{MBF3}$: Crank angles that constitute a set of an arbitrary crank angle and a mass burn fraction according to the crank angle are given in three different sets;

$\theta_s$: First crank angle according to the timing of ignition.

11. The detecting device according to claim 1, further comprising:

a control unit that controls an operational state of the internal combustion engine on the basis of the calculated mass burn fraction.

12. A detecting method that detects a combustion state of an internal combustion engine that transmits power via a crankshaft, the detecting method comprising:

a process of calculating a mass burn fraction by detecting a crank angle, on the basis of a frequency component showing a state change amount of a state change of a detection target according to a change in a cylinder pressure depending on a combustion cycle of the engine, and including a harmonic wave component of a fundamental wave of the frequency component.

* * * * *